US010154353B2

(12) United States Patent
Jensen et al.

(10) Patent No.: US 10,154,353 B2
(45) Date of Patent: Dec. 11, 2018

(54) MONAURAL SPEECH INTELLIGIBILITY PREDICTOR UNIT, A HEARING AID AND A BINAURAL HEARING SYSTEM

(71) Applicant: Oticon A/S, Smørum (DK)

(72) Inventors: Jesper Jensen, Smørum (DK); Asger Heidemann Andersen, Smørum (DK); Jan Mark De Haan, Smørum (DK)

(73) Assignee: Oticon A/S, Smørum (DK)

( * ) Notice: Subject to any disclaimer, the term of this patent is extended or adjusted under 35 U.S.C. 154(b) by 0 days.

(21) Appl. No.: 15/426,760

(22) Filed: Feb. 7, 2017

(65) Prior Publication Data

US 2017/0230765 A1 Aug. 10, 2017

(30) Foreign Application Priority Data

Feb. 8, 2016 (EP) ..... 16154704

(51) Int. Cl.
*H04R 25/00* (2006.01)
*G10L 25/60* (2013.01)
*G10L 21/0272* (2013.01)

(52) U.S. Cl.
CPC ..... *H04R 25/505* (2013.01); *G10L 25/60* (2013.01); *H04R 25/552* (2013.01);
(Continued)

(58) Field of Classification Search
CPC .. H04R 25/505; H04R 25/554; H04R 25/552; H04R 29/007; H04R 2225/51;
(Continued)

(56) References Cited

U.S. PATENT DOCUMENTS 8,964,997 B2 * 2/2015 Gauger, Jr. ..... G10L 21/02 381/102
9,226,084 B2 * 12/2015 Andersen ..... H04R 25/70
(Continued)

OTHER PUBLICATIONS

Ephraim et al. "A Signal Subspace Approach for Speech Enhancement", Jul. 1, 1995 http://ieeexpore.ieee.org/stamp/stamp.jsp?arnumber=397090.*
Taal et al. "An Algorithm for Intelligibility Prediction of Time-Frequency Weighted Noisy Speech", Sep. 2011 http://kom.aau.dk/~jje/pubs/jp/taal_et_al_2011_taslp.pdf.*
Yong et al. "A Regression Approach to Speech Enhancement Based on Deep Neural Networks", Jan. 1, 2015 http://ieeexplore.ieee.org/stamp/stamp.jsp?arnumber=6932438.*
(Continued)

*Primary Examiner* — Yogeshkumar Patel
(74) *Attorney, Agent, or Firm* — Birch, Stewart, Kolasch & Birch, LLP

(57) ABSTRACT

Signal processing methods for predicting the intelligibility of speech, e.g., in the form of an index that correlate highly with the fraction of words that an average listener (amongst a group of listeners with similar hearing profiles) would be able to understand from some speech material are proposed. Specifically, solutions to the problem of predicting the intelligibility of speech signals, which are distorted, e.g., by noise or reverberation, and which might have been passed through some signal processing device, e.g., a hearing aid are described. In summary, the disclosure present solutions to the following problems:

1. Monaural, non-intrusive intelligibility prediction of noisy/processed speech signals
2. Binaural, non-intrusive intelligibility prediction of noisy/processed speech signals
3. Monaural and binaural intelligibility enhancement of noisy speech signals.

21 Claims, 9 Drawing Sheets

(52) U.S. Cl.
CPC ..... *H04R 25/554* (2013.01); *G10L 21/0272* (2013.01); *H04R 2225/43* (2013.01); *H04R 2225/51* (2013.01)

(58) Field of Classification Search
CPC ..... H04R 2225/43; G10L 25/60; G10L 25/69; G10L 21/0272; G10L 21/0208
USPC ..... 704/205, E21.002, 227; 381/317, 321
See application file for complete search history.

(56) References Cited

U.S. PATENT DOCUMENTS

| | | | | |
|---|---|---|---|---|
| 9,524,733 | B2 * | 12/2016 | Skoglund | G10L 25/60 |
| 9,749,756 | B2 * | 8/2017 | Dittberner | H04R 25/40 |
| 2005/0141737 | A1 * | 6/2005 | Hansen | G10L 21/0208 381/316 |
| 2006/0262938 | A1 * | 11/2006 | Gauger, Jr. | G10L 21/02 381/56 |
| 2011/0054887 | A1 * | 3/2011 | Muesch | H04R 5/04 704/225 |
| 2011/0152708 | A1 * | 6/2011 | Adachi | A61B 5/04845 600/544 |
| 2011/0224976 | A1 * | 9/2011 | Taal | G10L 25/69 704/205 |
| 2012/0221328 | A1 * | 8/2012 | Muesch | G10L 21/0205 704/225 |
| 2013/0287236 | A1 * | 10/2013 | Kates | H04R 25/505 381/312 |
| 2014/0270294 | A1 * | 9/2014 | Andersen | G10L 21/02 381/321 |
| 2014/0365211 | A1 * | 12/2014 | Hetherington | G10L 25/60 704/205 |
| 2015/0012265 | A1 * | 1/2015 | van Wijngaarden | G10L 25/69 704/205 |
| 2015/0142450 | A1 * | 5/2015 | Liang | G10L 19/26 704/500 |
| 2015/0281857 | A1 * | 10/2015 | Hau | H04R 25/353 381/317 |
| 2016/0189707 | A1 * | 6/2016 | Donjon | H03G 7/002 704/205 |
| 2017/0251985 | A1 * | 9/2017 | Howard | A61B 5/7282 |
| 2017/0311093 | A1 * | 10/2017 | Andersen | H04R 25/50 |
| 2017/0311094 | A1 * | 10/2017 | Andersen | H04R 25/50 |

OTHER PUBLICATIONS

Ephraim et al. "A Signal Subspace Approach for Speech Enhancement", Jul. 1, 1995 http://ieeexplore.ieee.org/stamp/stmp.jsp?arnumber=397090.*

Wijngaarden et al. "Binaural Intelligibility Prediction based on the Speech Transmission Index", Mar. 14, 2008 http://asa.scitation.org/doi/pdf/10.1121/1.2905245.*

Taal et al., "An Algorithm for Intelligibility Prediction of Time-Frequency Weighted Noisy Speech", IEEE Transactions on Audio, Speech, and Language Processing, vol. 19, No. 7, Sep. 1, 2011, pp. 2125-2136.

Ellaham et al., "Binaural Objective Intelligibility Measurement and Hearing Aids", Canadian Acoustics, Journal of the Canadian Acoustical Association, vol. 37, No. 3, Sep. 1, 2009, pp. 136-137.

Van Wijngaarden et al., "Binaural Intelligibility Prediction Based on the Speech Transmission Index", The Journal of the Acoustical Society of America, vol. 123, No. 6, Jan. 1, 2008, pp. 4514-4523.

Ephraim et al., "A Signal Subspace Approach for Speech Enhancement", IEEE Transactions on Speech and Audio Processing, vol. 3, No. 4, Jul. 1, 1995, pp. 251-266.

Xu et al., "A Regression Approach to Speech Enhancement Based on Deep Neural Networks", IEEE/ACM Transactions on Audio, Speech, and Language Processing, vol. 23, No. 1, Jan. 1, 2015, pp. 7-19.

Bronkhorst, "The Cocktail Party Phenomenon: A Review of Research on Speech Intelligibility in Multiple Talker Conditions," Acta Acustica, vol. 86, No. 1, Jan. 2000, pp. 117-128.

Dau et al., "A quantitative model of the "effective" signal processing in the auditory system. I. Model structure," Journal of the Acoustic Society of America, vol. 99, No. 6, Jun. 1996, pp. 3615-3622.

Falk et al., "Objective Quality and Intelligibility Prediction for Users of Assistive Listening Devices," IEEE Signal Process Magazine, vol. 32, No. 2, Mar. 2015, pp. 1-24.

Jensen et al., "Minimum Mean-Square Error Estimation of Mel-Frequency Cepstal Features—A Theoretically Consistent Approach," IEEE Transactions on Audio, Speech, and Language Processing, vol. 23, No. 1, 2015, pp. 1-13.

Jensen et al., "Speech Intelligibility Prediction Based on Mutual Information," IEEE/ACM Transactions on Audio, Speech, and Language Processing, vol. 22, No. 2, Feb. 2014, pp. 430-440 (12 pages total).

* cited by examiner

MONAURAL SPEECH INTELLIGIBILITY PREDICTOR UNIT, A HEARING AID AND A BINAURAL HEARING SYSTEM

SUMMARY

The present disclosure provide solutions to the following problems:

1. Monaural, non-intrusive intelligibility prediction of noisy/processed speech signals
2. Binaural, non-intrusive intelligibility prediction of noisy/processed speech signals
3. Monaural and binaural intelligibility enhancement of noisy speech signals.

A Monaural Speech Intelligibility Predictor Unit:

In an aspect of the present application a monaural speech intelligibility predictor unit adapted for receiving an information signal x comprising either a clean or noisy and/or processed version of a target speech signal is provided. The monaural speech intelligibility predictor unit is configured to provide as an output a speech intelligibility predictor value d for the information signal. The speech intelligibility predictor unit comprises

- An input unit for providing a time-frequency representation x(k,m) of the information signal x, k being a frequency bin index, k=1, 2, . . . , K, and m being a time index;
- An envelope extraction unit for providing a time-frequency sub-band representation $x_j(m)$ of the information signal x representing temporal envelopes, or functions thereof, of frequency sub-band signals $x_j(m)$ of said information signal x, j being a frequency sub-band index, j=1, 2, . . . , J, and m being the time index;
- A time-frequency segment division unit for dividing said time-frequency sub-band representation $x_j(m)$ of the information signal x into time-frequency segments $X_m$ corresponding to a number N of successive samples of said sub-band signals;
- A segment estimation unit for estimating essentially noise-free time-frequency segments $S_m$ or normalized and/or transformed versions $\tilde{S}_m$ thereof, among said time-frequency segments $X_m$, or normalized and/or transformed versions $\tilde{X}_m$ thereof, respectively;
- An intermediate speech intelligibility calculation unit adapted for providing intermediate speech intelligibility coefficients $d_m$ estimating an intelligibility of said time-frequency segment $X_m$, said intermediate speech intelligibility coefficients $d_m$ being based on said estimated essentially noise-free time segments $S_m$ or normalized and/or transformed versions $\tilde{S}_m$ thereof, and said time-frequency segments $X_m$, or normalized and/or transformed versions $\tilde{X}_m$ thereof, respectively;
- A final speech intelligibility calculation unit for calculating a final speech intelligibility predictor d estimating an intelligibility of said information signal x by combining, e.g. averaging or applying a MIN or MAX-function, said intermediate speech intelligibility coefficients $d_m$, or a transformed version thereof, over time.

In an embodiment, the input unit is configured to receive information signal x as a time variant (time domain/full band) signal x(n), n being a time index. In an embodiment, the input unit is configured to receive information signal x in a time-frequency representation x(k,m) from another unit or device, k and m being frequency and time indices, respectively. In an embodiment, the input unit comprises a frequency decomposition unit for providing a time-frequency representation x(k,m) of the information signal x from a time domain version of the information signal x(n), n being a time index. In an embodiment, the frequency decomposition unit comprises a band-pass filterbank (e.g., a Gamma-tone filter bank), or is adapted to implement a Fourier transform algorithm (e.g. a short-time Fourier transform (STFT) algorithm). In an embodiment, the input unit comprises an envelope extraction unit for extracting a temporal envelope $x_j(m)$ comprising J sub-bands (j=1, 2, . . . , J) of the information signal from said time-frequency representation x(k,m) of the information signal x. In an embodiment, the envelope extraction unit comprises an algorithm for implementing a Hilbert transform, or for low-pass filtering the magnitude of complex-valued STFT signals x(k, m), etc. In an embodiment, the time-frequency segment division unit is configured to divide the time frequency representation $x_j(m)$ into time-frequency segments corresponding to N successive samples of selected, such as all, sub-band signals $x_j(m)$, j=1, 2, . . . , J. For example, the $m^{th}$ time-frequency segment $X_m$ is defined by the J×N matrix $$X_m = \begin{bmatrix} x_1(m-N+1) & \dots & x_1(m) \\ \vdots & & \vdots \\ x_J(m-N+1) & \dots & x_J(m) \end{bmatrix}.$$

In an embodiment, the monaural speech intelligibility predictor unit comprises a normalization and/or transformation unit adapted for providing normalized and/or transformed versions $\tilde{X}_m$ of said time-frequency segments $X_m$.

In an embodiment, the normalization and/or transformation unit is configured to apply one or more algorithms for row and/or column normalization and/or transformation to the time-frequency segments $S_m$ and/or $X_m$. In an embodiment, the normalization and/or transformation unit is configured to provide normalization and/or transformation operations of rows and/or columns of the time-frequency segments $S_m$ and/or $X_m$.

In an embodiment, monaural speech intelligibility predictor unit comprises a normalization and transformation unit configured to provide normalization and/or transformation of rows and columns of said time-frequency segments $S_m$ and $X_m$, wherein said normalization and/or transformation of rows comprises at least one of the following operations R1) mean normalization of rows, R2) unit-norm normalization of rows, R3) Fourier transform of rows, R4) providing a Fourier magnitude spectrum of rows, and R5) providing the identity operation, and wherein said normalization and/or transformation of columns comprises at least one of the following operations C1) mean normalization of columns, and C2) unit-norm normalization of columns.

In an embodiment, the normalization and/or transformation unit is configured to apply one or more of the following algorithms to the time-frequency segments $X_m$ (or $S_m$)

R1) Normalization of rows to zero mean:

$$g_1(X)=X-\mu_x^r\underline{1}^T,$$

where $\mu_x^r$, is a J×1 vector whose j'th entry is the mean of the j'th row of X (hence the superscript r in $\mu_x^r$), where $\underline{1}$ denotes an N×1 vector of ones, and where superscript T denotes matrix transposition;

R2) Normalization of rows to unit-noun:

$$g_2(X)=D^r(X)X,$$

where $D^r(X)=\mathrm{diag}([1/\sqrt{X(1,:)X(1,:)^H} \quad . \quad . \quad . \quad 1/\sqrt{X(J,:)X(J,:)^H}])$, and where X(j,:) denotes the j'th row of X, such that $D^r(X)$ is a J×J diagonal matrix with the inverse norm of each row on the main diagonal, and zeros elsewhere (the superscript H denotes Hermitian transposition). Pre-multiplication with $D^r(X)$ normalizes the rows of the resulting matrix to unit-norm;

R3) Fourier transformation applied to each row $$g_3(X)=XF,$$

where F is an N×N Fourier matrix;

R4) Fourier transformation applied to each row followed by computing the magnitude of the resulting complex-valued elements $$g_4(X)=|XF|$$

where |•| computes the element-wise magnitudes;

R5) The identity operator $$g_5(X)=X$$

C1) Normalization of columns to zero mean:

$$h_1(X)=X-\underline{1}\mu_x^{c^T},$$

where $\mu_x^c$ is a N×1 vector whose $i^{th}$ entry is the mean of the $i^{th}$ row of X, and where $\underline{1}$ denote an J×1 vector of ones;

C2) Normalization of columns to unit-norm:

$$h_2(X)=XD^c(X),$$

where $D^c(X)=\mathrm{diag}(\lfloor 1/\sqrt{X(:,1)^H X(:,1)} \ldots 1/\sqrt{X(:,N)^H X(:,N)}\rfloor)$, where X(:,n) denotes the n'th row of X, such that $D^c(X)$ is a diagonal N×N matrix with the inverse norm of each column on the main diagonal, and zeros elsewhere, and where post-multiplication with $D^c(X)$ normalizes the rows of the resulting matrix to unit-norm.

In an embodiment, the monaural speech intelligibility predictor unit comprises a voice activity detector (VAD) unit for indicating whether or not or to what extent a given time-segment of the information signal comprises or is estimated to comprise speech, and providing a voice activity control signal indicative thereof. In an embodiment, the voice activity detector unit is configured to provide a binary indication identifying segments comprising speech or no speech. In an embodiment, the voice activity detector unit is configured to identify segments comprising speech with a certain probability. In an embodiment, the voice activity detector is applied to a time-domain signal (or full-band signal, x(n), n being a time index). In an embodiment, the voice activity detector is applied to a time-frequency representation of the information signal (x(k,m), or $x_j(m)$, k and j being frequency indices (bin and sub-band, respectively), m being a time index) or a signal originating therefrom. In an embodiment, the voice activity detector unit is configured to identify time-frequency segments comprising speech on a time-frequency unit level (or e.g. in a frequency sub-band signal $x_j(m)$) In an embodiment, the monaural speech intelligibility predictor unit is adapted to receive a voice activity control signal from another unit or device. In an embodiment, the monaural speech intelligibility predictor unit is adapted to wirelessly receive a voice activity control signal from another device. In an embodiment, the time-frequency segment division unit and/or the segment estimation unit is/are configured to base the generation of the time-frequency segments $X_m$ or normalized and/or transformed versions $\tilde{X}_m$ thereof and of the estimates of the essentially noise-free time-frequency segments $S_m$ or normalized and/or transformed versions $\tilde{S}_m$ thereof on the voice activity control signal, e.g. to generate said time-frequency segments in dependence of the voice activity control signal (e.g. only if the probability that the time-frequency segment in question contains speech is larger than a predefined value, e.g. 0.5).

In an embodiment, the monaural speech intelligibility predictor unit (e.g. the envelope extraction unit) is adapted to extract said temporal envelope signals as $$x_j(m) = f\left(\sqrt{\sum_{k=k1(j)}^{k2(j)} |x(k, m)|^2}\right),$$

where j=1, . . . , J and m=1, . . . , M, k1(j) and k2(j) denote DFT bin indices corresponding to lower and higher cut-off frequencies of the $j^{th}$ sub-band, J is the number of sub-bands, and M is the number of signal frames in the signal in question, and f(•) is a function.

In an embodiment, the function f(•)=f(w), where w represents $$\left(\sqrt{\sum_{k=k1(j)}^{k2(j)} |x(k, m)|^2}\right),$$

is selected among the following functions f(w)=w representing the identity $f(w)=w^2$ providing power envelopes, $f(w)=2\cdot\log w$ or $f(w)=w^\beta$, $0\leq\beta<2$, allowing the modelling of the compressive non-linearity of the healthy cochlea, or combinations thereof.

In an embodiment, the function f(•)=f(w), where w represents $$\left(\sqrt{\sum_{k=k1(j)}^{k2(j)} |x(k, m)|^2}\right),$$

is selected among the following functions $f(w)=w^2$ providing power envelopes, $f(w)=2\cdot\log w$ or $f(w)=w^\beta$, $0<\beta<2$, allowing the modelling of the compressive non-linearity of the healthy cochlea, or combinations thereof.

In an embodiment, the segment estimation unit is configured to estimate the essentially noise-free time-frequency segments $\tilde{S}_m$ from time-frequency segments $\tilde{X}_m$ representing the information signal based on statistical methods.

In an embodiment, the segment estimation unit is configured to estimate said essentially noise-free time-frequency segments $S_m$ or normalized and/or transformed versions $\tilde{S}_m$ thereof based on super-vectors $\tilde{x}_m$ derived from time-frequency segments $X_m$ or from normalized and/or transformed time-frequency segments $\tilde{X}_m$ of the information signal, and an estimator $r(\tilde{x}_m)$ that maps the super vectors $\tilde{x}_m$ of the information signal to estimates $\hat{\tilde{S}}_m$ of super vectors $\tilde{s}_m$ representing the essentially noise-free, optionally normalized and/or transformed time-frequency segments $\tilde{S}_m$. In an embodiment, the super vectors $\tilde{x}_m$ and $\tilde{s}_m$ are J·N×1 super-vectors generated by stacking the columns of the (optionally normalized and/or transformed) time-frequency segments $\tilde{X}_m$ of the information signal, and the essentially noise-free (optionally normalized and/or transformed) time-frequency segments $\tilde{S}_m$, respectively, i.e.

$$\tilde{x}_m=[\tilde{X}_m(:,1)^T\tilde{X}_m(:,2)^T \ldots \tilde{X}_m(:,N)^T]^T,$$

$$\tilde{s}_m=[\tilde{S}_m(:,1)^T\tilde{S}_m(:,2)^T \ldots \tilde{S}_m(:,N)^T]^T,$$

where J is the number of frequency sub-bands, N is the number of successive samples of (optionally normalized and/or transformed) time-frequency segments $\tilde{X}_m$, $\tilde{S}_m$, $(:,n)^T$ denotes the n'th column of the matrix in question, and T denotes transposition.

In an embodiment, the statistical methods comprise one or more of a) neural networks, e.g. where the map r(.) is estimated offline using supervised learning techniques, b) Bayesian techniques, e.g., where the joint probability density function of (e.g. $\tilde{s}_m$, $\tilde{x}_m$) is estimated offline and used for providing estimates of $\tilde{s}_m$, which are optimal in a statistical sense, e.g., minimum mean-square error (mmse) sense, maximum a posteriori (MAP) sense, or maximum likelihood (ML) sense, etc., c) subspace techniques (having the potential of being computationally simple).

In an embodiment, the statistical methods comprise a class of solutions involving maps r(.), which are linear in the observations $\tilde{x}_m$. This has the advantage of being a particularly (computationally) simple approach, and hence well suited for portable (low power capacity) devices, such as hearing aids.

In an embodiment, the segment estimation unit is configured to estimate the essentially noise-free time-frequency segments $\tilde{S}_m$ based on a linear estimator. In an embodiment, the linear estimator is determined in an offline procedure (prior to the normal use of the monaural speech intelligibility predictor unit using a (potentially large) training set of noise-free speech signals. In an embodiment, $\hat{\tilde{s}}_{m\,m}=G\tilde{x}_m$ (i.e. $r(\tilde{x}_m)=G\cdot\tilde{x}_m$), where the J·N×1 super-vector $\hat{\tilde{s}}_m$ is an estimate of $\tilde{s}_m$, and G is a J·N×J·N matrix estimated in an off-line procedure using a training set of noise-free speech signals. An estimate $\hat{\tilde{S}}_m$ of the (clean) essentially noise-free time-frequency segments $S_m$ can e.g. be found by reshaping the estimate of super-vector $\hat{\tilde{s}}_m$ to a time-frequency segment matrix $(\hat{\tilde{S}}_m)$. .

In an embodiment, the segment estimation unit is configured to estimate the essentially noise-free, optionally normalized and/or transformed, time-frequency segments ($S_m$, $\tilde{S}_m$) based on a pre-estimated J·N×J·N sample correlation matrix $$\hat{R}_{\tilde{z}} = \frac{1}{\tilde{M}}\sum_{m=1}^{\tilde{M}} \tilde{z}_m\tilde{z}_m^H,$$

across a training set of super vectors $\tilde{z}_m$ derived from optionally normalized and/or transformed segments of noise-free speech signals $z_m$, where $\tilde{M}$ is the number of entries in the training set. Preferably, $\tilde{z}_m$ is a super vector (one of $\tilde{M}$) for an exemplary clean speech time segment. $\hat{R}_{\tilde{z}}$ represents a (crude) statistical model of a typical speech signal. The confidence of the model can be improved by increasing the number of entries $\tilde{M}$ in the training set and/or increasing the diversity of the entries $\tilde{z}_m$ in the training set. In an embodiment, the training set is customized (e.g. in number and/or diversity of entries) to the application in question, e.g. focused on entries that are expected to occur.

In an embodiment, the intermediate speech intelligibility calculation unit is adapted to determine the intermediate speech intelligibility coefficients $d_m$ in dependence on a, e.g. linear, sample correlation coefficient d(a,b) of the elements in two K×1 vectors defined by:

$$d(a,b) = \frac{\sum_{k=1}^{K}(a(k)-\mu_a)(b(k)-\mu_b)}{\sqrt{\sum_{k=1}^{K}(a(k)-\mu_a)^2(b(k)-\mu_b)^2}}, \text{ where}$$

$$\mu_a = \frac{1}{K}\sum_{k=1}^{K} a(k) \text{ and } \mu_b = \frac{1}{K}\sum_{k=1}^{K} b(k),$$

where k is the index of the vector entry and K is the vector dimension.

In an embodiment, the final speech intelligibility calculation unit is adapted to calculate the final speech intelligibility predictor d from the intermediate speech intelligibility coefficients $d_m$, optionally transformed by a function $u(d_m)$, as an average over time of said information signal x:

$$d = \frac{1}{M}\sum_{m=1}^{M} u(d_m)$$

where M represents the duration in time units of the speech active parts of said information signal x. In an embodiment, the duration of the speech active parts of the information signal is defined as a (possibly accumulated) time period where the voice activity control signal indicates that the information signal comprises speech.

A Hearing Aid:

In an aspect, a hearing aid adapted for being located at or in left and right ears of a user, or for being fully or partially implanted in the head of the user, the hearing aid comprising a monaural speech intelligibility predictor unit as described above, in the detailed description of embodiments, in the drawings and in the claims is furthermore provided by the present disclosure.

In an embodiment, the hearing aid according comprises

At least one input unit, such as a multitude of input units $IU_i$, i=1, . . . . , M, M being larger than or equal to two, each being configured to provide a time-variant electric input signal $y'_i$ representing a sound input received at an $i^{th}$ input unit, the electric input signal $y'_i$ comprising a target signal component and a noise signal component, the target signal component originating from a target signal source;

A configurable signal processor for processing the electric input signals and providing a processed signal u;

An output unit for creating output stimuli configured to be perceivable by the user as sound based on an electric output either in the form of the processed signal u from the signal processor or a signal derived therefrom; and A hearing loss model unit operatively connected to the monaural speech intelligibility predictor unit and configured to apply a frequency dependent modification of the electric output signal reflecting a hearing impairment of the corresponding left or right ear of the user to provide information signal x to the monaural speech intelligibility predictor unit.

The hearing loss model is configured to provide that the input signal to the monaural speech intelligibility predictor unit (e.g. the output of the configurable processing unit, cf. e.g. FIG. 8A) is modified to reflect a deviation of a user's hearing profile from a normal hearing profile, e.g. to reflect a hearing impairment of the user.

In an embodiment, the configurable signal processor is adapted to control or influence the processing of the respective electric input signals based on said final speech intelligibility predictor d provided by the monaural speech intelligibility predictor unit. In an embodiment, the configurable signal processor is adapted to control or influence the processing of the respective electric input signals based on said final speech intelligibility predictor d when the target signal component comprises speech, such as only when the target signal component comprises speech (as e.g. defined by a voice (speech) activity detector).

In an embodiment, the hearing aid is adapted to provide a frequency dependent gain and/or a level dependent compression and/or a transposition (with or without frequency compression) of one or frequency ranges to one or more other frequency ranges, e.g. to compensate for a hearing impairment of a user.

In an embodiment, the output unit comprises a number of electrodes of a cochlear implant or a vibrator of a bone conducting hearing aid. In an embodiment, the output unit comprises an output transducer. In an embodiment, the output transducer comprises a receiver (loudspeaker) for providing the stimulus as an acoustic signal to the user. In an embodiment, the output transducer comprises a vibrator for providing the stimulus as mechanical vibration of a skull bone to the user (e.g. in a bone-attached or bone-anchored hearing aid).

In an embodiment, the input unit comprises an input transducer for converting an input sound to an electric input signal. In an embodiment, the input unit comprises a wireless receiver for receiving a wireless signal comprising sound and for providing an electric input signal representing said sound. In an embodiment, the hearing aid comprises a directional microphone system adapted to enhance a target acoustic source among a multitude of acoustic sources in the local environment of the user wearing the hearing aid. In an embodiment, the directional system is adapted to detect (such as adaptively detect) from which direction a particular part of the microphone signal originates.

In an embodiment, the hearing aid comprises an antenna and transceiver circuitry for wirelessly receiving a direct electric input signal from another device, e.g. a communication device or another hearing aid. In general, a wireless link established by antenna and transceiver circuitry of the hearing aid can be of any type. In an embodiment, the wireless link is used under power constraints, e.g. in that the hearing aid comprises a portable (typically battery driven) device.

In an embodiment, the hearing aid comprises a forward or signal path between an input transducer (microphone system and/or direct electric input (e.g. a wireless receiver)) and an output transducer. In an embodiment, the signal processor is located in the forward path. In an embodiment, the signal processor is adapted to provide a frequency dependent gain according to a user's particular needs. In an embodiment, the hearing aid comprises an analysis path comprising functional components for analyzing the input signal (e.g. determining a level, a modulation, a type of signal, an acoustic feedback estimate, etc.). In an embodiment, some or all signal processing of the analysis path and/or the signal path is conducted in the frequency domain. In an embodiment, some or all signal processing of the analysis path and/or the signal path is conducted in the time domain.

In an embodiment, the hearing aid comprises an analogue-to-digital (AD) converter to digitize an analogue input with a predefined sampling rate, e.g. 20 kHz. In an embodiment, the hearing aid comprises a digital-to-analogue (DA) converter to convert a digital signal to an analogue output signal, e.g. for being presented to a user via an output transducer.

In an embodiment, the hearing aid comprises a number of detectors configured to provide status signals relating to a current physical environment of the hearing aid (e.g. the current acoustic environment), and/or to a current state of the user wearing the hearing aid, and/or to a current state or mode of operation of the hearing aid. Alternatively or additionally, one or more detectors may form part of an external device in communication (e.g. wirelessly) with the hearing aid. An external device may e.g. comprise another hearing aid, a remote control, and audio delivery device, a telephone (e.g. a Smartphone), an external sensor, etc. In an embodiment, one or more of the number of detectors operate(s) on the full band signal (time domain). In an embodiment, one or more of the number of detectors operate(s) on band split signals ((time-) frequency domain).

In an embodiment, the hearing aid further comprises other relevant functionality for the application in question, e.g. compression, noise reduction, feedback reduction, etc.

Use of a Monaural Speech Intelligibility Predictor Unit:

In an aspect, use of a monaural speech intelligibility predictor unit as described above, in the detailed description of embodiments, in the drawings and in the claims in a hearing aid to modify signal processing in the hearing aid aiming at enhancing intelligibility of a speech signal presented to a user by the hearing aid is furthermore provided by the present disclosure.

A Method of Providing a Monaural Speech Intelligibility Predictor:

In a further aspect, a method of providing a monaural speech intelligibility predictor for estimating a user's ability to understand an information signal x comprising either a clean or noisy and/or processed version of a target speech signal is provided. The method comprises

- Providing a time-frequency representation x(k,m) of said information signal x, k being a frequency bin index, k=1, 2, . . . , K, and m being a time index;
- Extracting temporal envelopes of said frequency time-frequency representation x(k,m) providing a time-frequency sub-band representation $x_j(m)$ of the information signal x representing temporal envelopes, or functions thereof, in the form of frequency sub-band signals $x_j(m)$, j being a frequency sub-band index, j=1, 2, . . . , J, and m being the time index;
- Dividing said time-frequency representation $x_j(m)$ of the information signal x into time-frequency segments $X_m$ corresponding to a number N of successive samples of said sub-band signals;
- Estimating essentially noise-free time-frequency segments $S_m$ or normalized and/or transformed versions $\tilde{S}_m$ thereof, among said time-frequency segments $X_m$, or normalized and/or transformed versions $\tilde{X}_m$ thereof, respectively;
- Providing intermediate speech intelligibility coefficients $d_m$ estimating an intelligibility of said time-frequency segment $X_m$, said intermediate speech intelligibility coefficients $d_m$ being based on said estimated essentially noise-free time segments $S_m$ or normalized and/or transformed versions $\tilde{S}_m$ thereof, and said time-frequency segments $X_m$, or normalized and/or transformed versions $\tilde{X}_m$ thereof, respectively;
- Calculating a final speech intelligibility predictor d estimating an intelligibility of said information signal x by combining, e.g. averaging, said intermediate speech intelligibility coefficients $d_m$, or a transformed version thereof, over time, e.g. in a single scalar value.

It is intended that some or all of the structural features of the device described above, in the 'detailed description of embodiments' or in the claims can be combined with embodiments of the method, when appropriately substituted by a corresponding process and vice versa. Embodiments of the method have the same advantages as the corresponding devices.

In an embodiment, the method comprises identifying whether or not or to what extent a given time-segment of the information signal comprises or is estimated to comprise speech. In an embodiment, the method provides a binary indication identifying segments comprising speech or no speech. In an embodiment, the method identifies segments comprising speech with a certain probability. In an embodiment, the method identifies time-frequency segments comprising speech on a time-frequency unit level (e.g. in a frequency sub-band signal $x_j(m)$). In an embodiment, the method comprises wirelessly receiving a voice activity control signal from another device.

In an embodiment, the method comprises subjecting a speech signal (a signal comprising speech) to a hearing loss model configured to model imperfections of an impaired auditory system to thereby provide said information signal x. By subjecting the speech signal (e.g. signal y in FIG. 3A) to a hearing loss model, the resulting information signal x can be used as an input to the speech intelligibility predictor, thereby providing a measure of the intelligibility of the speech signal for an unaided hearing impaired person. In an embodiment, the hearing loss model is a generalized model reflecting a hearing impairment of an average hearing impaired user. In an embodiment, the hearing loss model is configurable to reflect a hearing impairment of a particular user, e.g. including a frequency dependent hearing loss (deviation of a hearing threshold from a (n average) hearing threshold of a normally hearing person). By subjecting a speech signal (e.g. signal y in FIG. 3D) to a signal processing intended to compensate for the user's hearing impairment, AND to a hearing loss model the resulting information signal x can be used as an input to the speech intelligibility predictor (cf. e.g. FIG. 3D), thereby providing a measure of the intelligibility of the speech signal for an aided hearing impaired person. Such scheme may e.g. be used to evaluate the influence of different processing algorithms (and/or modifications of processing algorithms) on the user's (estimated) intelligibility of the resulting information signal or be used to online optimization of signal processing in a hearing aid (cf. e.g. 8A).

In an embodiment, the method comprises adding noise to a target speech signal to provide said information signal x, which is used as input to the method of providing a monaural speech intelligibility predictor value. The addition of a predetermined (or varying) amount of noise to an information signal can be used to—in a simple way—emulate a hearing loss of a user (to provide the effect of a hearing loss model). In an embodiment, the target signal is modified (e.g. attenuated) according to the hearing loss of a user, e.g. an audiogram. In an embodiment, noise is added to a target signal AND the target signal is attenuated to reflect a hearing loss of a user.

In an embodiment, the method comprises providing dividing the time frequency representation $x_j(m)$ into time-frequency segments $X_m$ corresponding to N successive samples of all sub-band signals $x_j(m)$, j=1, 2, . . . , J. For example, the $m^{th}$ time-frequency segment $X_m$ is defined by the J×N matrix $$X_m = \begin{bmatrix} x_1(m-N+1) & \dots & x_1(m) \\ \vdots & & \vdots \\ x_J(m-N+1) & \dots & x_J(m) \end{bmatrix}.$$

In an embodiment, the method comprises providing a normalization and/or transformation of the time-frequency segments $X_m$ to provide normalized and/or transformed time-frequency segments $\tilde{X}_m$. In an embodiment, the normalization and/or transformation unit is configured to apply one or more algorithms for row and/or column normalization and/or transformation to the time-frequency segments $X_m$.

In an embodiment, the method comprises providing that the essentially noise-free time-frequency segments $\tilde{S}_m$ from time-frequency segments $\tilde{X}_m$ representing the information signal are estimated based on statistical methods.

In an embodiment, the method comprises that the generation of the time-frequency segments $X_m$ or normalized and/or transformed versions $\tilde{X}_m$ thereof and of the estimates of the essentially noise-free time-frequency segments $S_m$ or normalized and/or transformed versions $\tilde{S}_m$ thereof are generated in dependence of whether or not or to what extent a given time-segment of the information signal comprises or is estimated to comprise speech (e.g. only if the probability that the time-frequency segment in question contains speech is larger than a predefined value, e.g. 0.5).

In an embodiment, the method comprises providing that the essentially noise-free time-frequency segments $S_m$ or normalized and/or transformed versions $\tilde{S}_m$ thereof are estimated based on super-vectors $\tilde{x}_m$ defined by time-frequency segments $X_m$ or by normalized and/or transformed time-frequency segments $\tilde{X}_m$ of the information signal, and an estimator $r(\tilde{x}_m)$ that maps the super vectors $\tilde{x}_m$ of the information signal to estimates $\hat{\tilde{s}}_m$ of super vectors $\tilde{s}_m$ representing the essentially noise-free, optionally normalized and/or transformed time-frequency segments $\tilde{S}_m$. In an embodiment, the super vectors $\tilde{x}_m$ and $\tilde{s}_m$ are J·N×1 super-vectors generated by stacking the columns of the (optionally normalized and/or transformed) time-frequency segments $\tilde{X}_m$ of the information signal, and the essentially noise-free (optionally normalized and/or transformed) time-frequency segments $\tilde{S}_m$, respectively, i.e.

$$\tilde{x}_m=[\tilde{X}_m(:,1)^T\tilde{X}_m(:,2)^T \dots \tilde{X}_m(:,N)^T]^T,$$

$$\tilde{s}_m=[\tilde{S}_m(:,1)^T\tilde{S}_m(:,2)^T \dots \tilde{S}_m(:,N)^T]^T,$$

where J is the number of frequency sub-bands, N is the number of successive samples of (optionally normalized and/or transformed) time-frequency segments $\tilde{X}_m$, $\tilde{S}_m$, $(:,n)^T$ denotes the n'th column of the matrix in question, and T denotes transposition.

In an embodiment, the method comprises providing that the essentially noise-free time-frequency segments $\tilde{S}_m$ are estimated based on a linear estimator.

In an embodiment, the method comprises providing estimates $\hat{\tilde{s}}_m$ of super vectors $\tilde{s}_m$, $\hat{\tilde{s}}_m = G\tilde{x}_m$, where the J·N×1 super-vector $\hat{\tilde{s}}_m$ is an estimate of the super vector $\tilde{s}_m$ representing the essentially noise-free, optionally normalized and/or transformed time-frequency segments $\tilde{S}_m$, and wherein the linear estimator G is a J·N×J·N matrix estimated in an off-line procedure using a training set of noise-free speech signals z(n) (n being a time index), or super vectors $z_m$.

In an embodiment, the method comprises providing that the essentially noise-free, optionally normalized and/or transformed, time-frequency segments ($S_m$, $\tilde{S}_m$) are estimated based on a pre-estimated J·N×J·N sample correlation matrix $$\hat{R}_{\tilde{z}} = \frac{1}{\tilde{M}} \sum_{m=1}^{\tilde{M}} \tilde{z}_m \tilde{z}_m^H,$$

across a training set of super vectors $\tilde{z}_m$ of noise-free speech signals $z_m$, where $\tilde{M}$ is the number of entries in the training set, the correlation matrix $\hat{R}_{\tilde{z}}$ representing a statistical model of a typical speech signal.

In an embodiment, the method comprises computing the eigen-value decomposition of the J·N×J·N sample correlation matrix $\hat{R}_{\tilde{z}\tilde{z}}$, $$\hat{R}_{\tilde{z}} = U_{\tilde{z}} \Lambda_{\tilde{z}} U_{\tilde{z}}^H,$$

where $\Lambda_{\tilde{z}}$ is a diagonal J·N×J·N matrix with real-valued eigenvalues in decreasing order, and where the columns of the J·N×J·N matrix $U_{\tilde{z}}$ are the corresponding eigen vectors.

In an embodiment, the method comprises partitioning the eigen vector matrix $U_{\tilde{z}}$ into two submatrices $$U_{\tilde{z}} = \lfloor U_{\tilde{z},1} U_{\tilde{z},2} \rfloor,$$

where $U_{\tilde{z},1}$ is an J·N×L matrix with the eigenvectors corresponding to the L<J·N dominant eigenvalues, and $U_{\tilde{z},2}$ has the remaining eigen vectors as columns. As an example, L/(J·N) may be less than 50%, e.g. less than 33%, such as less than 20%. In an embodiment, J·N is around 500, and L is around 100 (leading to $U_{\tilde{z},1}$ being a 500×100 matrix (dominant sub-space), and $U_{\tilde{z},2}$ is a 500×400 matrix (inferior sub-space)).

In an embodiment, the method comprises computing the (J·N×J·N) matrix G as $$G = U_{\tilde{z},1} U_{\tilde{z},1}^H.$$

This example of matrix G may be recognized as an orthogonal projection operator. In this case, forming the estimate $\hat{\tilde{s}}_m = G\tilde{x}_m$ simply projects the noisy/processed super vector $\tilde{x}_m$ orthogonally onto the linear subspace spanned by the columns in $U_{\tilde{z},1}$. Alternatively, and more generally, the matrix $U_{\tilde{z},1}$ can be substituted by a matrix of the form $U_{\tilde{z},1}D$, where D is a diagonal weighting matrix. The diagonal weighting matrix D is configured to scale the columns of $U_{\tilde{z},1}$ according to their (e.g. estimated) importance.

In an embodiment, the method comprises estimating $\hat{\tilde{S}}_m$ of the (clean) essentially noise-free time-frequency segments $S_m$ by reshaping the estimate of super-vector $\hat{\tilde{s}}_m$ to a time-frequency segment matrix $\hat{\tilde{S}}_m$..

In an embodiment, the method comprises determining said intermediate speech intelligibility coefficients $d_m$ in dependence on a sample correlation coefficient d(a,b) of the elements in two K×1 vectors defined by:

$$d(a, b) = \frac{\sum_{k=1}^{K} (a(k) - \mu_a)(b(k) - \mu_b)}{\sqrt{\sum_{k=1}^{K} (a(k) - \mu_a)^2 (b(k) - \mu_b)^2}}, \text{ where}$$

-continued $$\mu_a = \frac{1}{K} \sum_{k=1}^{K} a(k) \text{ and } \mu_b = \frac{1}{K} \sum_{k=1}^{K} b(k),$$

where k is the index of the vector entry and K is the vector dimension.

In an embodiment, the method comprises providing that the final speech intelligibility predictor d is calculated from the intermediate speech intelligibility coefficients $d_m$, optionally transformed by a function $u(d_m)$, as an average over time of said information signal x:

$$d = \frac{1}{M} \sum_{m=1}^{M} u(d_m)$$

where M represents the duration in time units of the speech active parts of said information signal x. In an embodiment, the duration of the speech active parts of the information signal is defined as a (possibly accumulated) time period where it has been identified that a given time-segment of the information signal comprises speech.

A (First) Binaural Hearing System:

In an aspect, a (first) binaural hearing system comprising left and right hearing aids as described above, in the detailed description of embodiments and drawings and in the claims is furthermore provided.

In an embodiment, each of the left and right hearing aids comprises antenna and transceiver circuitry for allowing a communication link to be established and information to be exchanged between said left and right hearing aids.

In an embodiment, the binaural hearing system further comprising a binaural speech intelligibility prediction unit for providing a final binaural speech intelligibility measure $d_{binaural}$ of the predicted speech intelligibility of the user, when exposed to said sound input, based on the monaural speech intelligibility predictor values $d_{left}$, $d_{right}$ of the respective left and right hearing aids.

In an embodiment, the final binaural speech intelligibility measure $d_{binaural}$ is determined as the maximum of the speech intelligibility predictor values $d_{left}$, $d_{right}$ of the respective left and right hearing aids: $d_{binaural} = \max(d_{left}, d_{right})$. Thereby a relatively simple system is provided implementing a better ear approach. In an embodiment, the binaural hearing system is adapted to activate such approach when an asymmetric listening situation is detected or selected by the user, e.g. a situation where a speaker is located predominantly to one side of the user wearing the binaural hearing system, e.g. when sitting in a car.

In an embodiment, the respective configurable signal processors of the left and right hearing aids are adapted to control or influence the processing of the respective electric input signals based on said final binaural speech intelligibility measure $d_{binaural}$. In an embodiment, the respective configurable signal processors of the left and right hearing aids are adapted to control or influence the processing of the respective electric input signals to maximize said final binaural speech intelligibility measure $d_{binaural}$.

A (First) Method of Providing a Binaural Speech Intelligibility Predictor:

In a further aspect, a (first) method of providing a binaural speech intelligibility predictor $d_{binaural}$ for estimating a user's ability to understand an information signal x comprising either a clean or noisy and/or processed version of a target speech signal, when said information is received at both ears of the user is further provided, The method comprises at each of the left and right ears of the user:

Providing a time-frequency representation x(k,m) of the information signal x, k being a frequency bin index, k=1, 2, . . . , K, and m being a time index;

Extracting temporal envelopes of said frequency time-frequency representation x(k,m) providing a time-frequency sub-band representation $x_j(m)$ of the information signal x representing temporal envelopes, or functions thereof, in the form of frequency sub-band signals $x_j(m)$, j being a frequency sub-band index, j=1, 2, . . . , J, and m being the time index;

Dividing said time-frequency representation $x_j(m)$ of the information signal x into time-frequency segments $X_m$ corresponding to a number N of successive samples of said sub-band signals;

Estimating essentially noise-free time-frequency segments $S_m$ or normalized and/or transformed versions $\tilde{S}_m$ thereof, among said time-frequency segments $X_m$, or normalized and/or transformed versions $\tilde{X}_m$ thereof, respectively;

Providing intermediate speech intelligibility coefficients $d_m$ estimating an intelligibility of said time-frequency segment $X_m$, said intermediate speech intelligibility coefficients $d_m$ being based on said estimated essentially noise-free time segments $S_m$ or normalized and/or transformed versions $\tilde{S}_m$ thereof, and said time-frequency segments $X_m$, or normalized and/or transformed versions $\tilde{X}_m$ thereof, respectively;

Calculating a final speech intelligibility predictor d estimating an intelligibility of said information signal x by combining, e.g. averaging, said intermediate speech intelligibility coefficients $d_m$, or a transformed version thereof, over time.

Whereby respective final monaural speech intelligibility predictor values $d_{left}$, $d_{right}$ at the respective left and right ears are provided. The method further comprises Calculating a final binaural speech intelligibility measure $d_{binaural}$ based on said final speech intelligibility predictor values $d_{left}$, $d_{right}$ at the respective left and right ears.

In an embodiment, the method provides that the final binaural speech intelligibility measure $b_{binaural}$ is determined as the maximum of the speech intelligibility predictor values $d_{left}$, $d_{right}$ of the respective left and right ears: $d_{binaural}=\max(d_{left}, d_{right})$.

A (Second) Method of Providing a Binaural Speech Intelligibility Predictor:

In a further aspect, a (second) method of providing a binaural speech intelligibility predictor $d_{binaural}$ for estimating a user's ability to understand an information signal x comprising either a clean or noisy and/or processed version of a target speech signal, when said information is received at left and right ears of the user is provided. The method comprises:

a) Providing a time-frequency representation $x_{left,}(k,m)$ of the information signal x as received at said left ear, k being a frequency bin index, k=1, 2, . . . , K, and m being a time index;

b) Providing a time-frequency representation $x_{right,}(k,m)$ of the information signal x as received at said right ear, k being a frequency bin index, k=1, 2, . . . , K, and m being a time index;

c) Providing in each frequency band (k) time-shifted and amplitude adjusted left and right time-frequency signals $x_{left}'(k,m)$ and $x_{right}'(k,m)$, respectively;

d) Determining time-shift and amplitude adjustment of said left and right time-frequency signals $x_{left}'(k,m)$ and $x_{right}'(k,m)$ that maximize said binaural speech intelligibility predictor $d_{binaural}$.

In an embodiment, step c) and d) comprises c) Providing in each frequency band (k) systematically time-shifted and amplitude adjusted left and right time-frequency signals $x_{left}'(k,m)$ and $x_{right}'(k,m)$, respectively;

d1) Subtracting time-shifted and amplitude adjusted left and right time-frequency signals $x_{left}'(k,m)$ and $x_{right}'(k,m)$ from each other to provide resulting difference time-frequency signal $x_{ec}(k,m)$;

d2) Extracting temporal envelopes of said resulting difference time-frequency signal $x_{ec}(k,m)$ to provide a time-frequency sub-band representation $x_{ec,j}(m)$ of the resulting difference time-frequency signal, j being a frequency sub-band index, j=1, 2, . . . , J, and m being the time index;

d3) Dividing said time-frequency sub-band representation $x_j(m)$ of the resulting difference time-frequency signal into time-frequency segments $X_m$ corresponding to a number N of successive samples of said sub-band signals;

d4) Estimating essentially noise-free time-frequency segments $S_m$ or normalized and/or transformed versions $\tilde{S}_m$ thereof, among said time-frequency segments $X_m$, or normalized and/or transformed versions $\tilde{X}_m$ thereof, respectively;

d5) Providing intermediate speech intelligibility coefficients $d_m$ estimating an intelligibility of said time-frequency segment $X_m$, said intermediate speech intelligibility coefficients $d_m$ being based on said estimated essentially noise-free time segments $S_m$ or normalized and/or transformed versions $\tilde{S}_m$ thereof, and said time-frequency segments $X_m$, or normalized and/or transformed versions $\tilde{X}_m$ thereof, respectively;

d6) Calculating a binaural speech intelligibility predictor $d_{binaural}$ estimating an intelligibility of said information signal x by combining, e.g. averaging, said intermediate speech intelligibility coefficients $d_m$, or a transformed version thereof, over time.

d7) Repeating steps c)-d6) in order to find the time shift and amplitude adjustment that maximizes the binaural speech intelligibility predictor $d_{binaural}$.

In an embodiment, the method comprises in step d) that the maximized binaural speech intelligibility predictor $d_{binaural}$ is analytically or numerically determined, or determined via statistical methods.

In an embodiment, the method comprises identifying whether or not or to what extent a given time-segment of the information signal x as received at left and right ears of the user comprises or is estimated to comprise speech. The step of identifying whether or not or to what extent a given time-segment of the information signal x as received at left and right ears of the user comprises or is estimated to comprise speech may be performed in the time domain prior to steps a) and b) of the method (frequency decomposition). Alternatively, it may be performed after the frequency decomposition. Preferably, the method of providing a binaural speech intelligibility predictor $d_{binaural}$ is only executed on time segments of the information signal that has been identified to comprises speech (e.g. with a probability above a certain threshold value).

A Method of Providing Binaural Speech Intelligibility Enhancement:

In a further aspect, a method of providing binaural speech intelligibility enhancement in a binaural hearing aid system comprising left and right hearing aids located at or in left and right ears of the user, or being fully or partially implanted in the head of the user is further provided by the present disclosure. The method comprises a) Providing a multitude of L time-variant electric input signals $y'_i$, i=1, . . . , L, representing a sound input received at an $i^{th}$ input unit of the binaural hearing aid system, the electric input signal $y'_i$ comprising a target signal component and a noise signal component, the target signal component originating from a target signal source, at least one of the L time-variant electric input signals $y'_i$ being received at the left ear of the user, and at least another one of the L time-variant electric input signals $y'_i$ being received at the right ear of the user;

b) Processing the L time-variant electric input signals $y'_i$, and providing processed left and right signals $u_{left}$, $u_{right}$;

c) Applying a frequency dependent hearing loss model to the processed left and right signals $u_{left}$, $u_{right}$ to reflect a deviation of a user's hearing profile for the left and right ears from a normal hearing profile to provide left and right information signals $x_{left}$, $x_{right}$;

d) Calculating a binaural speech intelligibility predictor $d_{binaural}$ estimating an intelligibility of said sound input based on said left and right information signals $x_{left}$, $x_{right}$ according to the (second) method of providing a binaural speech intelligibility predictor $d_{binaural}$;

e) Adapting the processing in step b) to maximize said binaural speech intelligibility predictor $d_{binaural}$.

In an embodiment, the method comprises creating output stimuli configured to be perceivable by the user as sound at the left and right ears of the user based on processed left and right signals $u_{left}$, $u_{right}$, respectively, or signals derived therefrom.

A (Second) Binaural Hearing System:

In an aspect, a (second) binaural hearing system comprising left and right hearing aids configured to execute the method of providing binaural speech intelligibility enhancement as described above, in the detailed description of embodiments and drawings and in the claims is furthermore provided.

A Computer Readable Medium:

In an aspect, a tangible computer-readable medium storing a computer program comprising program code means for causing a data processing system to perform at least some (such as a majority or all) of the steps of any one of the methods described above, in the 'detailed description of embodiments' and in the claims, when said computer program is executed on the data processing system is furthermore provided by the present application.

By way of example, and not limitation, such computer-readable media can comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer. Disk and disc, as used herein, includes compact disc (CD), laser disc, optical disc, digital versatile disc (DVD), floppy disk and Blu-ray disc where disks usually reproduce data magnetically, while discs reproduce data optically with lasers. Combinations of the above should also be included within the scope of computer-readable media. In addition to being stored on a tangible medium, the computer program can also be transmitted via a transmission medium such as a wired or wireless link or a network, e.g. the Internet, and loaded into a data processing system for being executed at a location different from that of the tangible medium.

A Computer Program:

A computer program (product) comprising instructions which, when the program is executed by a computer, cause the computer to carry out (steps of) the method described above, in the 'detailed description of embodiments' and in the claims is furthermore provided by the present application.

A Data Processing System:

In an aspect, a data processing system comprising a processor and program code means for causing the processor to perform at least some (such as a majority or all) of the steps of the any one of the methods described above, in the 'detailed description of embodiments' and in the claims is furthermore provided by the present application.

A Hearing System:

In a further aspect, a hearing system comprising a hearing aid as described above, in the 'detailed description of embodiments', and in the claims, AND an auxiliary device is moreover provided.

In an embodiment, the system is adapted to establish a communication link between the hearing aid and the auxiliary device to provide that information (e.g. control and status signals, possibly audio signals) can be exchanged or forwarded from one to the other.

In an embodiment, the auxiliary device is or comprises a remote control for controlling functionality and operation of the hearing aid(s). In an embodiment, the function of a remote control is implemented in a SmartPhone, the SmartPhone possibly running an APP allowing to control the functionality of the audio processing device via the SmartPhone (the hearing aid(s) comprising an appropriate wireless interface to the SmartPhone, e.g. based on Bluetooth or some other standardized or proprietary scheme).

An APP:

In a further aspect, a non-transitory application, termed an APP, is furthermore provided by the present disclosure. The APP comprises executable instructions configured to be executed on an auxiliary device to implement a user interface for a hearing aid or a hearing (aid) system described above in the 'detailed description of embodiments', and in the claims. In an embodiment, the APP is configured to run on cellular phone, e.g. a smartphone, or on another portable device allowing communication with said hearing aid or said hearing system.

Definitions

In the present context, a 'hearing aid' refers to a device, such as e.g. a hearing instrument or an active ear-protection device or other audio processing device, which is adapted to improve, augment and/or protect the hearing capability of a user by receiving acoustic signals from the user's surroundings, generating corresponding audio signals, possibly modifying the audio signals and providing the possibly modified audio signals as audible signals to at least one of the user's ears. A 'hearing aid' further refers to a device such as an earphone or a headset adapted to receive audio signals electronically, possibly modifying the audio signals and providing the possibly modified audio signals as audible signals to at least one of the user's ears. Such audible signals may e.g. be provided in the form of acoustic signals radiated into the user's outer ears, acoustic signals transferred as mechanical vibrations to the user's inner ears through the bone structure of the user's head and/or through parts of the middle ear as well as electric signals transferred directly or indirectly to the cochlear nerve of the user.

The hearing aid may be configured to be worn in any known way, e.g. as a unit arranged behind the ear with a tube leading radiated acoustic signals into the ear canal or with a loudspeaker arranged close to or in the ear canal, as a unit entirely or partly arranged in the pinna and/or in the ear canal, as a unit attached to a fixture implanted into the skull bone, as an entirely or partly implanted unit, etc. The hearing aid may comprise a single unit or several units communicating electronically with each other.

More generally, a hearing aid comprises an input transducer for receiving an acoustic signal from a user's surroundings and providing a corresponding input audio signal and/or a receiver for electronically (i.e. wired or wirelessly) receiving an input audio signal, a (typically configurable) signal processing circuit for processing the input audio signal and an output means for providing an audible signal to the user in dependence on the processed audio signal. In some hearing aids, an amplifier may constitute the signal processing circuit. The signal processing circuit typically comprises one or more (integrated or separate) memory elements for executing programs and/or for storing parameters used (or potentially used) in the processing and/or for storing information relevant for the function of the hearing aid and/or for storing information (e.g. processed information, e.g. provided by the signal processing circuit), e.g. for use in connection with an interface to a user and/or an interface to a programming device. In some hearing aids, the output means may comprise an output transducer, such as e.g. a loudspeaker for providing an air-borne acoustic signal or a vibrator for providing a structure-borne or liquid-borne acoustic signal. In some hearing aids, the output means may comprise one or more output electrodes for providing electric signals.

In some hearing aids, the vibrator may be adapted to provide a structure-borne acoustic signal transcutaneously or percutaneously to the skull bone. In some hearing aids, the vibrator may be implanted in the middle ear and/or in the inner ear. In some hearing aids, the vibrator may be adapted to provide a structure-borne acoustic signal to a middle-ear bone and/or to the cochlea. In some hearing aids, the vibrator may be adapted to provide a liquid-borne acoustic signal to the cochlear liquid, e.g. through the oval window. In some hearing aids, the output electrodes may be implanted in the cochlea or on the inside of the skull bone and may be adapted to provide the electric signals to the hair cells of the cochlea, to one or more hearing nerves, to the auditory cortex and/or to other parts of the cerebral cortex.

A 'hearing system' refers to a system comprising one or two hearing aids, and a 'binaural hearing system' refers to a system comprising two hearing aids and being adapted to cooperatively provide audible signals to both of the user's ears. Hearing systems or binaural hearing systems may further comprise one or more 'auxiliary devices', which communicate with the hearing aid(s) and affect and/or benefit from the function of the hearing aid(s). Auxiliary devices may be e.g. remote controls, audio gateway devices, mobile phones (e.g. SmartPhones), public-address systems, car audio systems or music players. Hearing aids, hearing systems or binaural hearing systems may e.g. be used for compensating for a hearing-impaired person's loss of hearing capability, augmenting or protecting a normal-hearing person's hearing capability and/or conveying electronic audio signals to a person.

BRIEF DESCRIPTION OF DRAWINGS

The aspects of the disclosure may be best understood from the following detailed description taken in conjunction with the accompanying figures. The figures are schematic and simplified for clarity, and they just show details to improve the understanding of the claims, while other details are left out. Throughout, the same reference numerals are used for identical or corresponding parts. The individual features of each aspect may each be combined with any or all features of the other aspects. These and other aspects, features and/or technical effect will be apparent from and elucidated with reference to the illustrations described hereinafter in which:

The figures are schematic and simplified for clarity, and they just show details which are essential to the understanding of the disclosure, while other details are left out. Throughout, the same reference signs are used for identical or corresponding parts.

Figure 1A:
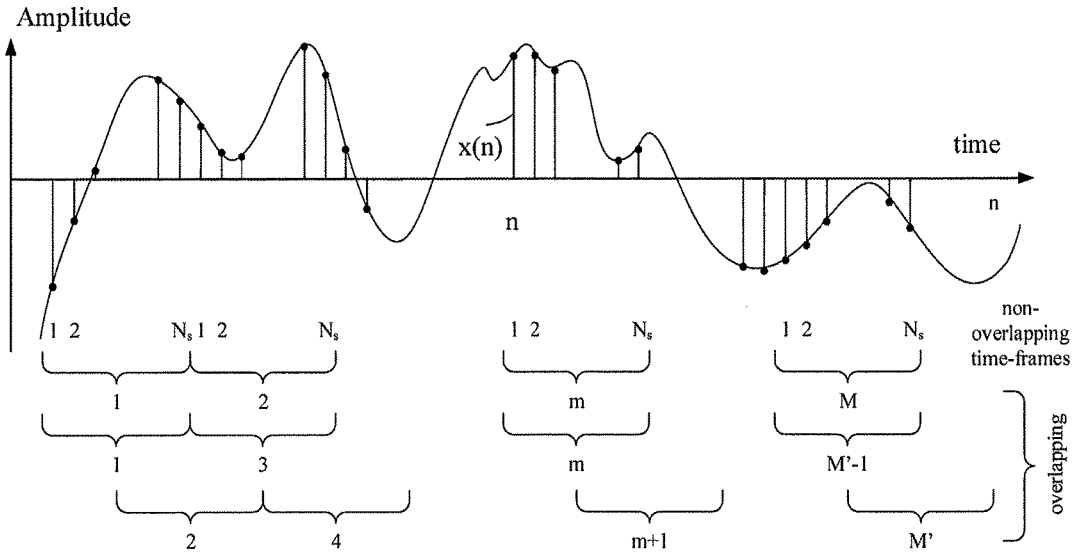
FIG. 1A schematically shows a time variant analogue signal (Amplitude vs time) and its digitization in samples, the samples being arranged in a number of time frames, each comprising a number $N_s$ of samples.

Further scope of applicability of the present disclosure will become apparent from the detailed description given hereinafter. However, it should be understood that the detailed description and specific examples, while indicating preferred embodiments of the disclosure, are given by way of illustration only. Other embodiments may become apparent to those skilled in the art from the following detailed description.

DETAILED DESCRIPTION OF EMBODIMENTS

The detailed description set forth below in connection with the appended drawings is intended as a description of various configurations. The detailed description includes specific details for the purpose of providing a thorough understanding of various concepts. However, it will be apparent to those skilled in the art that these concepts may be practised without these specific details. Several aspects of the apparatus and methods are described by various blocks, functional units, modules, components, circuits, steps, processes, algorithms, etc. (collectively referred to as "elements"). Depending upon particular application, design constraints or other reasons, these elements may be implemented using electronic hardware, computer program, or any combination thereof.

The electronic hardware may include microprocessors, microcontrollers, digital signal processors (DSPs), field programmable gate arrays (FPGAs), programmable logic devices (PLDs), gated logic, discrete hardware circuits, and other suitable hardware configured to perform the various functionality described throughout this disclosure. Computer program shall be construed broadly to mean instructions, instruction sets, code, code segments, program code, programs, subprograms, software modules, applications, software applications, software packages, routines, subroutines, objects, executables, threads of execution, procedures, functions, etc., whether referred to as software, firmware, middleware, microcode, hardware description language, or otherwise.

The present application relates to the field of hearing aids.

The present invention relates to specifically to signal processing methods for predicting the intelligibility of speech, e.g., in the form of an index that correlate highly with the fraction of words that an average listener (amongst a group of listeners with similar hearing profiles) would be able to understand from some speech material. Specifically, we present solutions to the problem of predicting the intelligibility of speech signals, which are distorted, e.g., by noise or reverberation, and which might have been passed through some signal processing device, e.g., a hearing aid. The invention is characterized by the fact that the intelligibility prediction is based on the noisy/processed signal only—in the literature, such methods are called non-intrusive intelligibility predictors, e.g. [1]. The non-intrusive class of methods, which we focus on in the present invention, is in contrast to the much larger class of methods which require a noise-free and unprocessed reference speech signal to be available too (e.g. [2,3,4], etc.)—this class of methods is called intrusive.

The core of the invention is a method for monaural, non-intrusive intelligibility prediction—in other words, given a noisy speech signal, picked up by a single microphone, and potentially passed through some signal processing stages, e.g. of a hearing aid system, we wish to estimate its' intelligibility. In the first part of the text below, we will provide an extensive description of a novel, general class of methods for solving this problem.

Next, we extend the invention to deal with the binaural, non-intrusive intelligibility problem.

The reason to for this extension is that listening to acoustic scenes using two ears (i.e., binaurally) can in certain situations increase the intelligibility dramatically over using only one ear (or presenting the same signal to both ears) [5].

Finally, we extend the invention even further to be used for monaural or binaural speech intelligibility enhancement. The problem solved here is the following: given noisy/reverberant speech signals, e.g. picked up by the microphones of a hearing aid system, process them in such a way that their intelligibility is improved or even maximized when presented binaurally to the user.

In summary, the disclosure present solutions to the following problems:

1. Monaural, non-intrusive intelligibility prediction of noisy/processed speech signals
2. Binaural, non-intrusive intelligibility prediction of noisy/processed speech signals
3. Monaural and binaural intelligibility enhancement of noisy speech signals.

Much of the signal processing of the present disclosure is performed in the time-frequency domain, where a time domain signal is transformed into the (time-)frequency domain by a suitable mathematical algorithm (e.g. a Fourier transform algorithm) or filter (e.g. a filter bank).

FIG. 1A schematically shows a time variant analogue signal (Amplitude vs time) and its digitization in samples, the samples being arranged in a number of time frames, each comprising a number $N_s$ of digital samples. FIG. 1A shows an analogue electric signal (solid graph), e.g. representing an acoustic input signal, e.g. from a microphone, which is converted to a digital audio signal in an analogue-to-digital (AD) conversion process, where the analogue signal is sampled with a predefined sampling frequency or rate $f_s$, $f_s$ being e.g. in the range from 8 kHz to 40 kHz (adapted to the particular needs of the application) to provide digital samples x(n) at discrete points in time n, as indicated by the vertical lines extending from the time axis with solid dots at its endpoint coinciding with the graph, and representing its digital sample value at the corresponding distinct point in time n. Each (audio) sample x(n) represents the value of the acoustic signal at n by a predefined number $N_b$ of bits, $N_b$ being e.g. in the range from 1 to 16 bits. A digital sample x(n) has a length in time of $1/f_s$, e.g. 50 μs, for $f_s$=20 kHz. A number of (audio) samples $N_s$ are arranged in a time frame, as schematically illustrated in the lower part of FIG. 1A, where the individual (here uniformly spaced) samples are grouped in time frames (1, 2, . . . , $N_s$)). As also illustrated in the lower part of FIG. 1A, the time frames may be arranged consecutively to be non-overlapping (time frames 1, 2, . . . , m, . . . , M) or overlapping (here 50%, time frames 1, 2, . . . , m, . . . , M'), where m is time frame index. In an embodiment, a time frame comprises 64 audio data samples. Other frame lengths may be used depending on the practical application.

Figure 1B:
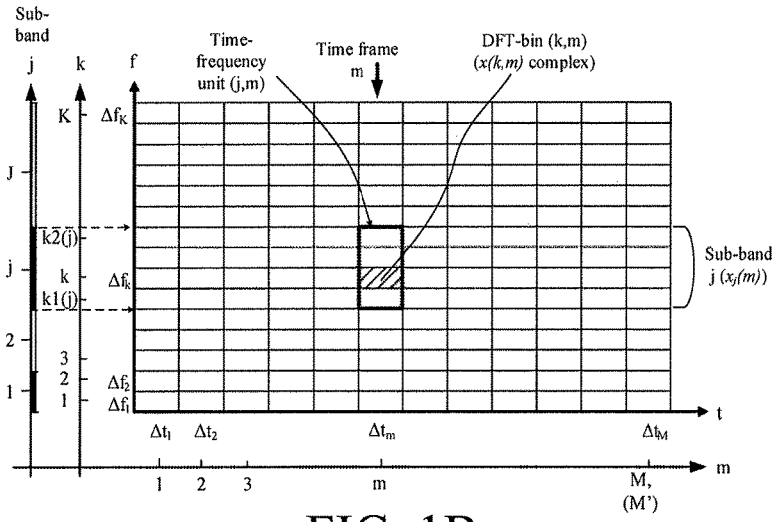
FIG. 1B illustrates a time-frequency map representation of the time variant electric signal of FIG. 1A, FIG. 2A symbolically shows a monaural speech intelligibility predictor unit providing a monaural speech intelligibility predictor d based on a time-frequency representation $x_j(m)$ of an information signal x.

FIG. 1B schematically illustrates a time-frequency representation of the (digitized) time variant electric signal x(n) of FIG. 1A. The time-frequency representation comprises an array or map of corresponding complex or real values of the signal in a particular time and frequency range. The time-frequency representation may e.g. be a result of a Fourier transformation converting the time variant input signal x(n) to a (time variant) signal x(k,m) in the time-frequency domain. In an embodiment, the Fourier transformation comprises a discrete Fourier transform algorithm (DFT). The frequency range considered by a typical hearing device (e.g. a hearing aid) from a minimum frequency $f_{min}$ to a maximum frequency $f_{max}$ comprises a part of the typical human audible frequency range from 20 Hz to 20 kHz, e.g. a part of the range from 20 Hz to 12 kHz. In FIG. 1B, the time-frequency representation x(k,m) of signal x(n) comprises complex values of magnitude and/or phase of the signal in a number of DFT-bins defined by indices (k,m), where k=1, . . . , K represents a number K of frequency values (cf. vertical k-axis in FIG. 1B) and m=1, . . . , M (M') represents a number M (M') of time frames (cf. horizontal m-axis in FIG. 1B). A time frame is defined by a specific time index m and the corresponding K DFT-bins (cf. indication of Time frame m in FIG. 1B). A time frame m represents a frequency spectrum of signal x at time m. A DFT-bin (k,m) comprising a (real) or complex value x(k,m) of the signal in question is illustrated in FIG. 1B by hatching of the corresponding field in the time-frequency map. Each value of the frequency index k corresponds to a frequency range $\Delta f_k$, as indicated in FIG. 1B by the vertical frequency axis f. Each value of the time index m represents a time frame. The time $\Delta t_m$ spanned by consecutive time indices depend on the length of a time frame (e.g. 25 ms) and the degree of overlap between neighbouring time frames (cf. horizontal t-axis in FIG. 1B).

In the present application, a number J of (non-uniform) frequency sub-bands with sub-band indices j=1, 2, . . . , J is defined, each sub-band comprising one or more DFT-bins (cf. vertical Sub-band j-axis in FIG. 1B). The $j^{th}$ sub-band (indicated by Sub-band j ($x_j(m)$) in the right part of FIG. 1B) comprises DFT-bins with lower and upper indices k1(j) and k2(j), respectively, defining lower and upper cut-off frequencies of the $j^{th}$ sub-band, respectively. A specific time-frequency unit (j,m) is defined by a specific time index m and the DFT-bin indices k1(j)-k2(j), as indicated in FIG. 1B by the bold framing around the corresponding DFT-bins. A specific time-frequency unit (j,m) contains complex or real values of the $j^{th}$ sub-band signal $x_j(m)$ at time m.

Figure 2A:
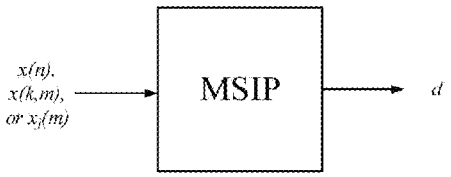
FIG. 2B shows an embodiment a monaural speech intelligibility predictor unit.

FIG. 2A symbolically illustrates a monaural speech intelligibility predictor unit (MSIP) providing a monaural speech intelligibility predictor d based on a time domain version x(n) (n being a time (sample) index), a time-frequency band representation x(k,m) (k being a frequency index, m being a time (frame) index) or a sub-band representation $x_j(m)$ (j being a frequency sub-band index) of an information signal x comprising speech.

Figure 2B:
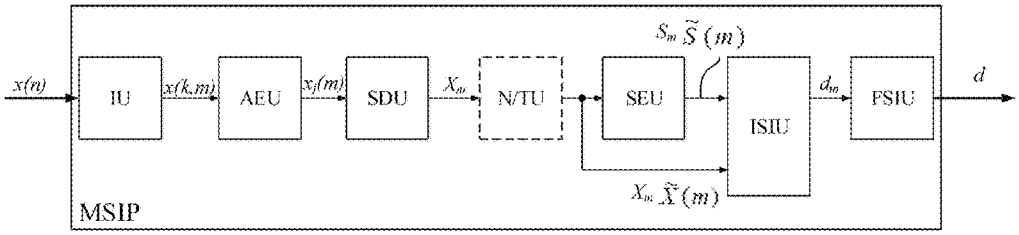

FIG. 2B shows an embodiment a monaural speech intelligibility predictor unit (MSIP) adapted for receiving an information signal x(n) comprising either a clean or noisy and/or processed version of a target speech signal, the speech intelligibility predictor unit being configured to provide as an output a speech intelligibility predictor value d for the information signal. The speech intelligibility predictor unit (MSIP) comprises

- an input unit (IU) for providing a time-frequency representation x(k,m) of said information signal x, k being a frequency bin index, k=1, 2, . . . , K, and m being a time (frame) index;
- An envelope extraction unit (AEU) for providing a time-frequency sub-band representation $x_j(m)$ of the information signal x from said time-frequency representation x(k,m) of said information signal x, representing temporal envelopes, or functions thereof, j being a frequency sub-band index, j=1, 2, . . . , J, and m being the time index;
- A time-frequency, segment division unit (SDU) for dividing said time-frequency sub-band representation $x_j(m)$ of the information signal x into time-frequency segments $X_m$ corresponding to a number N of successive samples of said sub-band signals;
- An optional (indicated by dashed outline) normalization and/or transformation unit (N/TU) adapted for providing normalized and/or transformed versions $\tilde{X}_m$ of the time-frequency segments $X_m$;
- A segment estimation unit (SEU) for estimating essentially noise-free time-frequency segments $S_m$ or normalized and/or transformed versions $\tilde{S}_m$ thereof, among said time-frequency segments $X_m$, or normalized and/or transformed versions $\tilde{X}_m$ thereof, respectively;
- An intermediate speech intelligibility calculation unit (ISIU) adapted for providing intermediate speech intelligibility coefficients $d_m$ estimating an intelligibility of said time-frequency segment $X_m$, said intermediate speech intelligibility coefficients $d_m$ being based on said estimated essentially noise-free time segments $S_m$ or normalized and/or transformed versions $\tilde{S}_m$ thereof, and said time-frequency segments $X_m$, or normalized and/or transformed versions $\tilde{X}_m$ thereof, respectively;
- A final speech intelligibility calculation unit (FSIU) for calculating a final speech intelligibility predictor d estimating an intelligibility of the information signal x by combining, e.g. averaging or applying a MIN or MAX-function, the intermediate speech intelligibility coefficients $d_m$, or a transformed version thereof, over time.

Figure 3A:
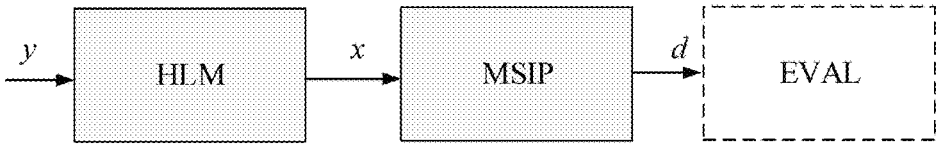
FIG. 3A shows a monaural speech intelligibility predictor unit in combination with a hearing loss model and an evaluation unit.

FIG. 3A shows a monaural speech intelligibility predictor unit (MSIP) in combination with a hearing loss model (HLM) and an (optional) evaluation unit (EVAL). The Monaural Speech Intelligibility Predictor (MSIP) estimates an intelligibility index d, which reflects the intelligibility of a noisy and potentially processed speech signal. A noisy/reverberant speech signal y, which potentially has been passed through some signal processing device, e.g. a hearing aid (cf. e.g. signal processor (SPU) in FIG. 3B, 3C, 3D), is considered for analysis by the monaural speech intelligibility predictor (MSIP). The present disclosure proposes an algorithm, which can predict the intelligibility of the signal noisy/processed signal, as perceived by a group of listeners with similar hearing profiles, e.g. normal hearing or hearing impaired listeners. In the embodiment of FIG. 3A, the signal under study, y, is passed through a hearing loss model (HLM), to model the imperfections of an impaired auditory system providing information signal x. This is done to simulate the potential decrease in intelligibility due to a hearing loss. Several methods for simulating a hearing loss exist (cf. e.g. [6]). The, perhaps, simplest consists of adding to the input signal a statistically independent noise signal, which is spectrally shaped according to the audiogram of the listener (cf. e.g. [7]). In the embodiment of FIGS. 3A (and 3B, 3C, 3D), an evaluation unit (EVAL) is included to evaluate the resulting speech intelligibility predictor value d. The evaluation unit (EVAL) may e.g. further process the speech intelligibility predictor value d, to e.g. graphically and/or numerically display the current and/or recent historic values, derive trends, etc. Alternatively, or additionally the evaluation unit may propose actions to the user (or a communication partner or caring person), such as add directionality, move closer, speak louder, activate SI-enhancement mode, etc. The evaluation unit may e.g. be implemented in a separate device, e.g. acting as a user interface to the speech intelligibility predictor unit (MSIP) and/or to a hearing aid including such unit, e.g. implemented as a remote control devise, e.g. as an APP of a smartphone (cf. FIG. 10A, 10B).

Figure 3B:
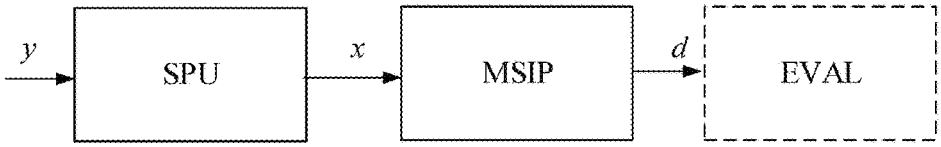
FIG. 3B shows a monaural speech intelligibility predictor unit in combination with a signal processor and an evaluation unit.

FIG. 3B shows a monaural speech intelligibility predictor unit (MSIP) in combination with a signal processor (SPU) and an (optional) evaluation unit (EVAL). A noisy/reverberant speech signal y is passed through a signal processor (SPU) and the processed output signal x thereof is used as an input to the monaural speech intelligibility predictor (MSIP) providing the resulting speech intelligibility predictor value d, which is fed to the evaluation unit (EVAL) for further processing, analysis and/or display.

Figure 3C:
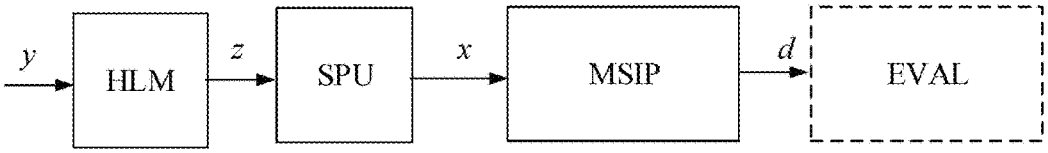
FIG. 3C shows a first combination of a monaural speech intelligibility predictor unit with a hearing loss model, a signal processor and an evaluation unit.

FIG. 3C shows a first combination of a monaural speech intelligibility predictor unit (MSIP) with a hearing loss model (HLM), a signal processor (SPU) and an (optional) evaluation unit (EVAL). A noisy signal, y, comprising speech is passed through a hearing loss model (HLM) to model the imperfections of an impaired auditory system providing noisy hearing loss shaped signal x, which is passed through a signal processor (SPU) and the processed output signal x thereof is used as an input to the monaural speech intelligibility predictor (MSIP). The MSIP-unit provides the resulting speech intelligibility predictor value d, which is fed to the evaluation unit (EVAL) for further processing, analysis and/or display.

Figure 3D:
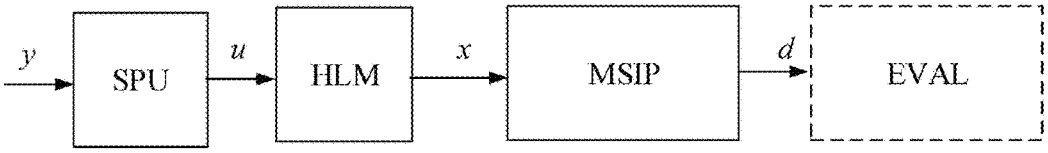
FIG. 3D shows a second combination of a monaural speech intelligibility predictor unit with a hearing loss model, a signal processor and an evaluation unit.

FIG. 3D shows a second combination of a monaural speech intelligibility predictor unit (MSIP) with a hearing loss model (HLM), a signal processor (SPU) and an (optional) evaluation unit (EVAL). The embodiment of FIG. 3D is similar to the embodiment of FIG. 3C apart from the two units HLM and SPU being sapped in order. The embodiment of FIG. 3D may reflect a setup used in a hearing aid to evaluate the intelligibility of a processed signal u from a signal processor (SPU) (e.g. intended for presentation to a user). The noisy signal comprising speech y is passed through the signal processor (SPU) and the processed output signal u thereof is passed through a hearing loss model (HLM) to model the imperfections of an impaired auditory system and providing noisy hearing loss shaped signal x, which is used by the monaural speech intelligibility predictor unit (MSIP) to determine the resulting speech intelligibility predictor value d, which is fed to the evaluation unit (EVAL) for further processing, analysis and/or display.

Figure 4:
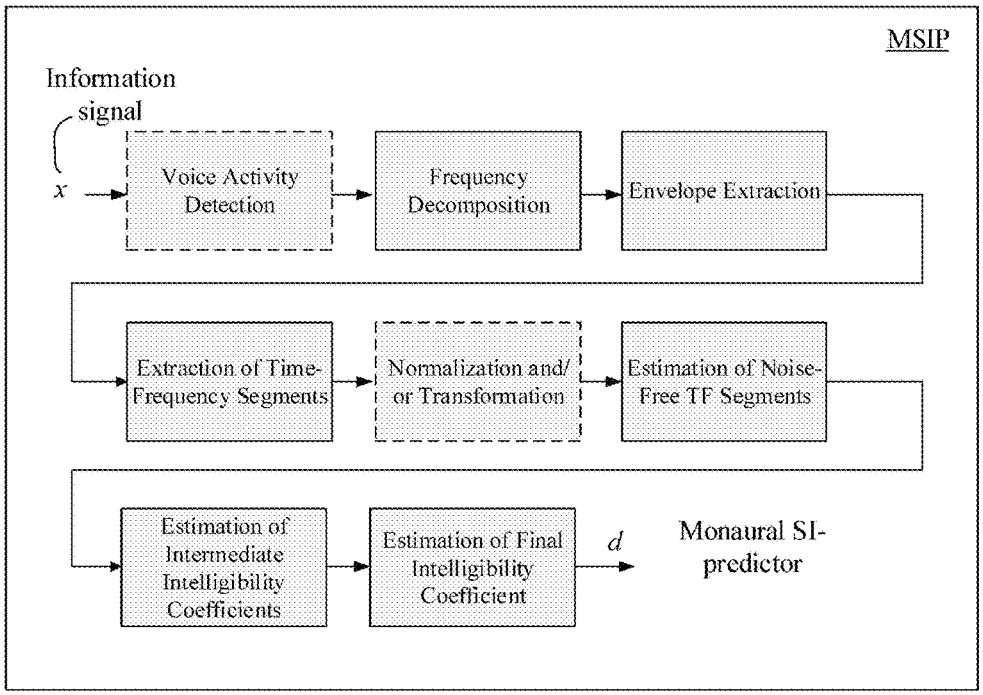
FIG. 4 shows an embodiment of a monaural speech intelligibility predictor according to the present disclosure, FIG. 5A symbolically shows a binaural speech intelligibility predictor in combination with a hearing loss model.

FIG. 4 shows an embodiment of a monaural speech intelligibility predictor unit (MSIP) according to the present disclosure. The embodiment of a monaural speech intelligibility predictor shown in FIG. 4 is decomposed into a number of sub-units (e.g. representing separate tasks of a corresponding method). Each sub-unit (process step) is described in more detail in the following. Sub-units (process steps) that are symbolized with dashed outline are optional.

Voice Activity Detection.

Speech intelligibility (SI) relates to regions of the input signal with speech activity—silence regions do no contribute to SI. Hence, in some realizations of the invention, the first step is to detect voice activity regions in the input signal (in other realizations, voice activity detection is performed implicitly at a later stage of the algorithm). The explicit voice activity detection can be done with any of a range of existing algorithms, e.g., [8,9] or the references therein. Let us denote the input signal with speech activity by x'(n), where n is a discrete-time index.

Frequency Decomposition and Envelope Extraction

The first step is to perform a frequency decomposition of the signal x(n). This may be achieved in many ways, e.g., using a short-time Fourier transform (STFT), a band-pass filterbank (e.g., a Gamma-tone filter bank), etc. Subsequently, the temporal envelopes of each sub-band signal are extracted. This may, e.g., be achieved using a Hilbert transform, or by low-pass filtering the magnitude of complex-valued STFT signals, etc.

As an example, we describe in the following how the frequency decomposition and envelope extraction can be achieved using an STFT. Let us assume a sampling frequency of 10000 Hz. First, a time-frequency representation is obtained by segmenting x'(n) into (e.g. 50%) overlapping, windowed frames; normally, some tapered window, e.g. a Hanning-window is used. The window length could e.g. be 256 samples when the sample rate is 10000 Hz. Then, each frame is Fourier transformed using a fast Fourier transform (FFT) (potentially after appropriate zero-padding). The resulting DFT bins may be grouped in perceptually relevant sub-bands. For example, one could use one-third octave bands (e.g. as in [4]), but it should be clear that any other sub-band division can be used (for example, the grouping could be uniform, i.e., unrelated to perception in this respect). In the case of one-third octave bands and a sampling rate of 10000 Hz, there are 15 bands which cover the frequency range 150-5000 Hz (cf. e.g. [4]). Other numbers of bands and another frequency range can be used. We refer to the time-frequency tiles defined by these frames and sub-bands as time-frequency (TF) units (or STFT coefficients). Applying this to the noisy/processed input signal x(n) leads to (generally complex-valued) STFT coefficients x(k,m), where k and m denote frequency and frame (time) indices, respectively. Temporal envelope signals may then be extracted as $$x_j(m) = f\left(\sqrt{\sum_{k=k1(j)}^{k2(j)} |x(k, m)|^2}\right),$$

j=1, . . . J, and m=1, . . . M, where k1(j) and k2(j) denote DFT bin indices corresponding to lower and higher cut-off frequencies of the j'th sub-band, J is the number of sub-bands, and M is the number of signal frames in the signal in question, and where the function $f(\bullet)=f(w)$, where w represents $$\left(\sqrt{\sum_{k=k1(j)}^{k2(j)} |x(k,m)|^2}\right),$$

is included for generality. In an embodiment, $x_j(m)$ is real (i.e. $f(\bullet)$ represents a real (non-complex) function). For example, for $f(w)=w$, we get the temporal envelope used in [4], with $f(w)=w^2$, we extract power envelopes, and with $f(w)=2\cdot\log w$ or $f(w)=w^\beta$, $0<\beta<2$, we can model the compressive non-linearity of the healthy cochlea (cf. e.g. [10, 11]). It should be clear that other reasonable choices for $f(w)$ exist.

As mentioned, other envelope representations may be implemented, e.g., using a Gammatone filterbank, followed by a Hilbert envelope extractor, etc, and functions $f(w)$ may be applied to these envelopes in a similar manner as described above for STFT based envelopes. In any case, the result of this procedure is a time-frequency representation in terms of sub-band temporal envelopes, $x_j(m)$, where j is a sub-band index, and m is a time index (cf. e.g. FIG. 1B).

Time-Frequency Segments

Next, we divide the time-frequency representation $x_j(m)$ into segments, i.e., spectrograms corresponding to N successive samples of all sub-band signals. For example, the m'th segment is defined by the J×N matrix $$X_m = \begin{bmatrix} x_1(m-N+1) & \dots & x_1(m) \\ \vdots & & \vdots \\ x_J(m-N+1) & \dots & x_J(m) \end{bmatrix}.$$

It should be understood that other versions of the time-segments could be used, e.g., segments, which have been shifted in time to operate on frame indices m−N/2+1 through m+N/2, to be centered around the current value of frame index m.

Normalizations and Transformation of Time-Frequency Segments

The rows and columns of each segment $X_m$ may be normalized/transformed in various ways.

In particular, we consider the following row normalizations/transformations:

Normalization of rows to zero mean:

$$g_1(X)=X-\mu_x^r\underline{1}^T,$$

where $\mu_x^r$ is a J×1 vector whose j'th entry is the mean of the j'th row of X (hence the superscript r in $\mu_x^r$), where $\underline{1}$ denotes an N×1 vector of ones, and where superscript T denotes matrix transposition).

Normalization of rows to unit-norm:

$$g_2(X)=D^r(X)X,$$

where $D^r(X)=\mathrm{diag}(\lfloor 1/\sqrt{X(1,:)X(1,:)^H} \;\ldots\; 1/\sqrt{X(J,:)X(J,:)^H}\rfloor)$. Here X(j,:) denotes the j'th row of X, such that $D^r(X)$ is a J×J diagonal matrix with the inverse norm of each row on the main diagonal, and zeros elsewhere (the superscript H denotes Hermitian transposition). Pre-multiplication with $D^r(X)$ normalizes the rows of the resulting matrix to unit-norm.

Fourier transformation applied to each row $$g_3(X)=XF,$$

where F is an N×N Fourier matrix.

Fourier transformation applied to each row followed by computing the magnitude of the resulting complex-valued elements $$g_4(X)=|XF|$$

where |•| (computes the element-wise magnitudes;

The identity operator $$g_5(X)=X$$

We further consider the following column normalizations

Normalization of columns to zero mean:

$$h_1(X)=X-\underline{1}\mu_x^{c^T},$$

where $\mu_x^c$ is a N×1 vector whose $i^{th}$ entry is the mean of the $i^{th}$ row of X, and where $\underline{1}$ denote an J×1 vector of ones.

Normalization of columns to unit-norm:

$$h_2(X)=XD^c(X),$$

where $D^c(X)=\mathrm{diag}(\lfloor 1/\sqrt{X(:,1)^H X(:,1)} \;\ldots\; 1/\sqrt{X(:,N)^H X(:,N)}\rfloor)$. Here X(:,n) denotes the n'th row of X, such that $D^c(X)$ is a diagonal N×N matrix with the inverse norm of each column on the main diagonal, and zeros elsewhere. Post-multiplication with $D^c(X)$ normalizes the rows of the resulting matrix to unit-norm.

The row- and column normalizations/transformations listed above may be combined in different ways One combination of particular interest is where, first, the rows are normalized to zero-mean and unit-norm, followed by a similar mean and norm normalization of the columns. This particular combination may be written as $$\tilde{X}_m=h_2(h_1(g_2(g_1(X_m)))),$$

where $\tilde{X}_m$ is the resulting row- and column normalized matrix.

Another transformation of interest is to apply a Fourier transform to each row of matrix $X_m$. With the introduced notation, this may be written simply as $$\tilde{X}_m=g_3(X_m),$$

where $\tilde{X}_m$ is the resulting (complex-valued) J×N matrix.

Other combinations of these normalizations/transformations may be of interest, e.g., $\tilde{X}_m=g_2(g_1(h_2(h_1(X_m))))$ (mean- and norm-standardization of the columns followed by mean- and norm-standardization of the rows), $\tilde{X}_m=g_2(g_1(g_3(X_m)))$ (mean- and norm-standardization of Fourier-transformed rows), $\tilde{X}_m=g_4(X_m)$, which completely bypasses the normalization stage, etc.

A still further combination is to provide at least one normalization and/or transformation operation of rows and at least one normalization and/or transformation operation of columns of said time-frequency segments $S_m$ and $X_m$.

Estimation of Noise-Free Time-Frequency Segments

The next step involves estimation of the underlying noise-free normalized/transformed time-frequency segment $\tilde{S}_m$. Obviously, this matrix cannot be observed in practice, since only the noisy/processed normalized/transformed time-frequency segment in matrix $\tilde{X}_m$ is available. So, we estimate $\tilde{S}_m$ based on $\tilde{X}_m$.

To this end, let us define a J·N×1 super-vector $\tilde{x}_m$ by stacking the columns of matrix $\tilde{X}_m$, i.e., $$\tilde{x}_m=[\tilde{X}_m(:,1)^T\tilde{X}_m(:,2)^T \ldots \tilde{X}_m(:,N)^T]^T.$$

Similarly, we define the corresponding noise-free/unprocessed super-vector $\tilde{s}_m$ as $$\tilde{s}_m=[\tilde{S}_m(:,1)^T\tilde{S}_m(:,2)^T \ldots \tilde{S}_m(:,N)^T]^T.$$

The goal is now to derive an estimate $\hat{\tilde{s}}_m$ of $\tilde{s}_m$ based on $\tilde{x}_m$, i.e., $$\hat{\tilde{s}}_m=r(\tilde{x}_m),$$

where r(.) is an estimator that maps J·N×1 noisy super-vectors to estimates of noise-free J·N×1 super-vectors.

The problem of estimating an un-observable target vector $\tilde{s}_m$ based on a related, but distorted, observation $\tilde{x}_m$ is a well-known problem in many engineering contexts, and many methods can be applied to solve it. These include (but are not limited to) methods based on neural networks, e.g. where the map r(.) is pre-estimated off-line, e.g. using supervised learning techniques, Bayesian techniques, e.g., where the joint probability density function of $(\tilde{s}_m,\tilde{x}_m)$ is estimated off-line and used for providing estimates of $\tilde{s}_m$, which are optimal in some statistical sense, e.g., minimum mean-square error (mmse) sense, maximum a posteriori (MAP) sense, or maximum likelihood (ML) sense, etc.

A particularly simple class of solutions involve maps r(.) which are linear in the observations $\tilde{x}_m$. In this solution class, we form a linear estimate $\hat{\tilde{s}}_m$ of the corresponding noise-free J·N×1 super-vector $\tilde{s}_m$ from linear combinations of the entries in $\tilde{x}_m$, i.e., $$\hat{\tilde{s}}_m = G\tilde{x}_m,$$

where G is a pre-estimated J·N×J·N matrix (see e.g. below for an example of how G can be found). Finally, an estimate $\hat{\tilde{S}}_m$ is found of the clean normalized/transformed segment by simply reshaping the super-vector estimate $\hat{\tilde{s}}_m$ to a time-frequency segment matrix, $$\hat{\tilde{S}}_m = \left[\ \hat{\tilde{s}}_m(1:J)\ \ \hat{\tilde{s}}_m(J+1:2J)\ \ \ldots\ \ \hat{\tilde{s}}_m(J(N-1)+1:JN)\ \right],$$

where $\hat{\tilde{s}}_m(r{:}q)$ denotes a vector consisting of entries of vector $\hat{\tilde{s}}_m$ with index r through q.

Estimation of Intermediate Intelligibility Coefficients

The estimated normalized/transformed time-frequency segment $\hat{\tilde{S}}_m$ may now be used together with the corresponding noisy/processed segment $\tilde{X}_m$ to compute an intermediate intelligibility index $d_m$, reflecting the intelligibility of the signal segment $\tilde{X}_m$. To do so, let us first define the sample correlation coefficient d(a,b) of the elements in two K×1 vectors a and b:

$$d(a,b) = \frac{\sum_{k=1}^{K}(a(k)-\mu_a)(b(k)-\mu_b)}{\sqrt{\sum_{k=1}^{K}(a(k)-\mu_a)^2(b(k)-\mu_b)^2}},\ \text{where}$$

$$\mu_a = \frac{1}{K}\sum_{k=1}^{K}a(k)\ \text{and}\ \mu_b = \frac{1}{K}\sum_{k=1}^{K}b(k).$$

Several options exist for computing the intermediate intelligibility index $d_m$. In particular, $d_m$ may be defined as 1) the average sample correlation coefficient of the columns in $\hat{\tilde{S}}_m$ and $$\tilde{X}_m,\ \text{i.e.},\ d_m = \frac{1}{N}\sum_{n=1}^{N}d\left(\hat{\tilde{S}}_m(:,n),\ \tilde{X}_m(:,n)\right),$$

or 2) the average sample correlation coefficient of the rows in $\hat{\tilde{S}}_m$ and $$\tilde{X}_m,\ \text{i.e.},\ d_m = \frac{1}{J}\sum_{j=1}^{J}d\left(\hat{\tilde{S}}_m(j,:)^T,\ \tilde{X}_m(j,:)^T\right),$$

or 3) the sample correlation coefficient of all elements in $\hat{\tilde{S}}_m$ and $\tilde{X}_m$, i.e., $$d_m = d\left(\hat{\tilde{s}}_m,\ \tilde{x}_m\right).$$

Alternatively, the noisy/processed segment $\tilde{X}_m$ and the corresponding estimate of the underlying clean segment $\hat{\tilde{S}}_m$ may be used to generate an estimate of the noise-free, unprocessed speech signals, which can be used with the noisy, processed signals as input to any existing intrusive intelligibility prediction scheme, e.g., the STOI algorithm (cf. e.g. [4]).

Estimation of Final Intelligibility Coefficient

The final intelligibility coefficient d, which reflects the intelligibility of the noisy/processed input signal x(n), is defined as the average of the intermediate intelligibility coefficients, potentially transformed via a function $u(d_m)$, across the duration of the speech-active parts of x(n) i.e., $$d = \frac{1}{M}\sum_{m=1}^{M}u(d_m).$$

The function $u(d_m)$ may for example be $$u(d_m) = \log\left(\frac{1}{1-d_m^2}\right),$$

to link the intermediate intelligibility coefficients to information measures (cf. e.g. [14]), but it should be clear that other choices exist.

The "do-nothing" function $u(d_m)=d_m$ may also be used, as has been done in the STOI algorithm (cf. [4]).

Pre-Computation of Linear Map

As outlined above, many methods exist for estimating the noise-free (potentially normalized/transformed) supervector $\tilde{s}_m$, based on the entries in the noisy/processed (and optionally normalized/transformed) supervector $\tilde{x}_m$. In this section—to demonstrate a particularly simple realization of the invention—we constrain our attention to linear estimators, i.e., where the estimate of $\tilde{s}_m$ is found as an appropriate linear combination of the entries in $\tilde{x}_m$. Any such linear combination may be written compactly as $$\hat{\tilde{s}}_m = G\tilde{x}_m,$$

where G is a pre-estimated J·N×J·N matrix. In general, J and N can be chosen according to the application in question. N may preferably be chosen with a view to characteristics of the human vocal system. In an embodiment, N is chosen, so that a time spanned by N (possibly overlapping) time frames is in the range from 50 ms or 100 ms to 1 s, e.g. between 300 ms and 600 ms. In embodiment, N is chosen to represent the (e.g. average or maximum) duration of a basic speech element of the language in question. In embodiment, N is chosen to represent the (e.g. average or maximum) duration of a syllable (or word) of the language in question. In an embodiment, J=15. In an embodiment, N=30. In an embodiment J·N=450. In an embodiment, a time frame has duration of 10 ms, or more, e.g. 25 ms or more, e.g. 40 ms or more (e.g. depending on a degree of overlap). In an embodiment, a time frame has a duration in the range between 10 ms and 40 ms.

As described in more detail in the following, the matrix G may be pre-estimated (i.e. off-line, prior to application of the proposed method or device) using a training set of noise-free speech signals. We can think of G as a way of building a priori knowledge of the statistical structure of speech signals into the estimation process. Many variants of this approach exist. In the following, one of them is described. This approach has the advantage of being computationally relatively simple, and hence well suited for applications (such as portable electronic devices, e.g. hearing aids) where power consumption is an important design parameter (restriction).

Let us for convenience assume that all noise-free training speech signals are concatenated into a (potentially very long) training speech signal z(n). Assume that the steps described above to find noisy super vectors $\tilde{x}_m$ are applied to the training speech signal z(n). In other words, z(n) is subject to voice activity detection, collection of samples into time-frequency segment matrices, applying relevant normalizations/transformations of the form $g_i(X)$, $h_i(X)$, to the matrices, and stacking the columns of the resulting matrices into super vectors $\tilde{z}_m$, m=1, . . . , $\tilde{M}$, where $\tilde{M}$ denotes the total number of segments in the entire noise-free speech training set.

We compute the J·N×J·N sample correlation matrix across the training set as $$\hat{R}_{\tilde{z}} = \frac{1}{\tilde{M}} \sum_{m=1}^{\tilde{M}} \tilde{z}_m \tilde{z}_m^H,$$

and compute the eigen-value decomposition of this matrix, $$\hat{R}_{\tilde{z}} = U_{\tilde{z}} \Lambda_{\tilde{z}} U_{\tilde{z}}^H,$$

where $\Lambda_{\tilde{z}}$ is a diagonal J·N×J·N matrix with real-valued eigenvalues in decreasing order, and where the columns of the J·N×J·N matrix $U_{\tilde{z}}$ are the corresponding eigen vectors.

Finally let us partition the eigen vector matrix $U_{\tilde{z}}$ into two submatrices $$U_{\tilde{z}} = [U_{\tilde{z},1} U_{\tilde{z},2}],$$

where $U_{\tilde{z},1}$ is an J·N×L matrix with the eigenvectors corresponding to the L<J·N dominant eigenvalues, and $U_{\tilde{z},2}$ has the remaining eigen vectors as columns. As an example, L/(J·N) may be less than 80%, such as less than 50%, e.g. less than 33%, such as less than 20% or less than 10%. In the above example of J·N=450, L may e.g. be 100 (leading to $U_{\tilde{z},1}$ being a 450×100 matrix (dominant sub-space), and $U_{\tilde{s},2}$ being a 450×350 matrix (inferior sub-space)).

The (J·N×J·N) matrix G may then be computed as $$G = U_{\tilde{z},1} U_{\tilde{z},1}^H.$$

This example of matrix G may be recognized as an orthogonal projection operator (cf. e.g. [12]). In this case, forming the estimate $\hat{\tilde{s}}_m = G\tilde{x}_m$ simply projects the noisy/processed super vector $\tilde{x}_m$ orthogonally onto the linear subspace spanned by the columns in $U_{\tilde{z},1}$.

Binaural, Non-Intrusive Intelligibility Prediction.

In principle, methods from the class of monaural, non-intrusive intelligibility predictors proposed above are able to predict the intelligibility of speech signals, when the listener listens with one ear. While this can already give a good indication of the intelligibility that can be achieved when listening with both ears, there exist acoustic situations, where two-ear listening is much more advantageous than listening with one ear (cf. e.g. [5]). To take this effect into account, a first binaural, non-intrusive speech intelligibility predictor $d_{binaural}$ (e.g. taking on values between −1 and 1) is proposed. The monaural intelligibility predictor described above serves as the basis for the proposed first binaural intelligibility predictor.

Figure 5A:
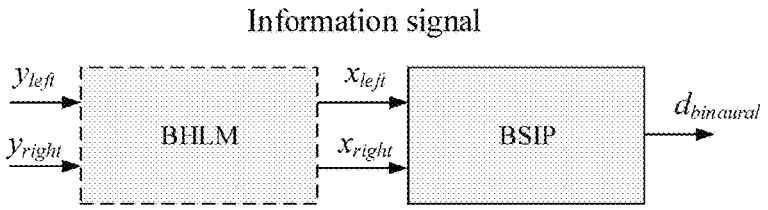
FIG. 5B shows an embodiment of a binaural speech intelligibility predictor based on a combination of two monaural speech intelligibility predictors in combination with a hearing loss model according to the present disclosure, FIG. 6 schematically shows processing steps of a method of providing a non-intrusive binaural speech intelligibility predictor according to the present disclosure, FIG. 7 schematically shows a method of providing an intrusive binaural speech intelligibility predictor $d_{binaural}$ for adapting the processing of a binaural hearing aid systems to maximize the intelligibility of output speech signal(s)

The general block diagram of the proposed binaural intelligibility predictor is shown in FIG. 5A. FIG. 5A shows a first binaural speech intelligibility predictor in combination with a hearing loss model. The Binaural Speech Intelligibility Predictor (BSIP) estimates an intelligibility index $d_{binaural}$, which reflects the intelligibility of a listener listening to two noisy and potentially processed information signals comprising speech $x_{left}$ and $x_{right}$ (presented to the listener's left and right ears, respectively). Optionally, (noisy and/or processed) binaural signals $y_{left}$ and $y_{right}$ comprising speech are passed through a binaural hearing loss model (BHLM) first, to model the imperfections of an impaired auditory system, providing noisy and/or processed hearing loss shaped signals $x_{left}$ and $x_{right}$ for use by the binaural speech intelligibility predictor (BSIP).

As for the monaural case, a potential hearing loss may be modelled by simply adding independent noise to the input signals, spectrally shaped according to the audiogram of the listener—this approach was e.g. used in [7].

Better-Ear Non-Intrusive Binaural Intelligibility Prediction

A simple method for binaural speech intelligibility prediction is to apply the monaural model described above independently to the left- and right-ear inputs signals $x_{left}$ and $x_{right}$, resulting in intelligibility indices $d_{left}$ and $d_{right}$, respectively. Assuming that the listener is able to mentally adapt to the ear with the best intelligibility, the resulting better-ear intelligibility predictor $d_{binaural}$ is given by:

$$d_{binaural} = \max(d_{left}, d_{right}).$$

Figure 5B:
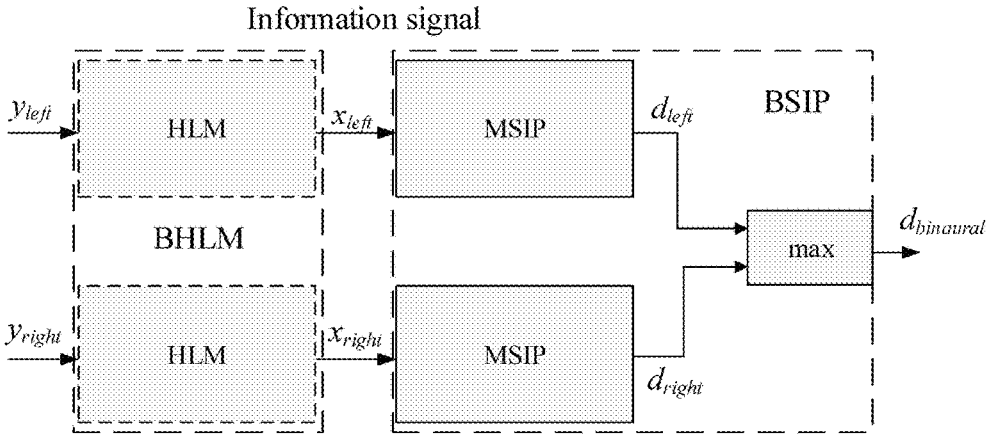

A block diagram of this approach is given in FIG. 5B

FIG. 5B shows an embodiment of a binaural speech intelligibility predictor based on a combination of two monaural speech intelligibility predictors in combination with a hearing loss model. FIG. 5B illustrates processing steps for determining a better-ear non-intrusive binaural intelligibility predictor $d_{binaural}$. Along the lines of FIG. 5A, FIG. 5B shows noisy and/or processed binaural signals $y_{left}$ and $y_{right}$ comprising speech are (in each of the left and right monaural speech intelligibility predictors), which are passed through respective hearing loss models (HLM) for the left and right ears, providing noisy and/or processed hearing loss shaped signals $x_{left}$ and $x_{right}$. Together, the hearing loss models (HLM) for the left and right ears may constitute or form part of the binaural hearing loss model (BHLM) of FIG. 5A. The left and right information signals $x_{left}$ and $x_{right}$ are used by the monaural speech intelligibility predictors (MSIP) of the left and right ears, respectively, to provide left and right (monaural) speech intelligibility predictors $d_{left}$ and $d_{right}$. A maximum value of the left and right speech intelligibility predictors $d_{left}$ and $d_{right}$ is determined by calculation unit (max) and used as the binaural intelligibility predictor $d_{binaural}$. Together, the monaural speech intelligibility predictors (MSIP) of the left and right ears and the calculation unit (max) may constitute or form part of the binaural speech intelligibility predictor (BSIP) of FIG. 5A.

General Non-Intrusive Binaural Intelligibility Prediction

While the better ear intelligibility prediction approach described above will work well in a wide range of acoustic situations (see e.g. [5] for a discussion of binaural intelligibility), there are acoustic situations, where it is too simple. To account for this, we propose to combine the steps of the monaural intrusive intelligibility predictor, outlined above, with ideas from the binaural, intrusive intelligibility predictor described in [13], to arrive at a general, novel non-intrusive binaural intelligibility predictor.

Figure 6:
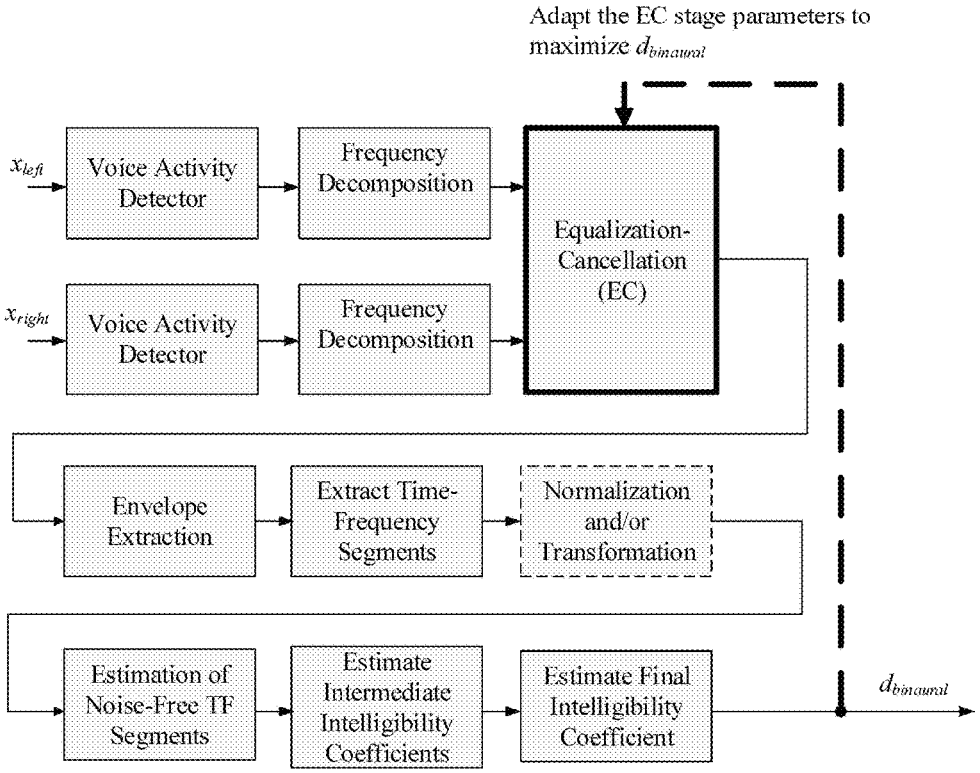

The processing steps of the proposed non-intrusive binaural intelligibility predictor are outlined in FIG. 6. The individual processing blocks in FIG. 6 are identical to the blocks used in the monaural, non-intrusive speech intelligibility predictor proposed above (FIG. 4), except for the Equalization-Cancellation stage (EC) (as indicated with a bold-faced box in FIG. 6). This stage, on the other hand, is completely described in [13]. In the following, the EC-stage is briefly outlined. For a detailed treatment, see [13] and the references therein.

The EC-stage operates independently on different frequency sub-bands (hence, the frequency decomposition stage before the EC-stage). In each sub-band (index j), the EC-stage time-shifts the input signals (from left and right ear) and adjusts their amplitudes in order to find the time shift and amplitude adjustment that leads to the maximum predicted intelligibility ($d_{binaural}$ in FIG. 5, hence, the bold dashed arrow from the output of the model leading back to the EC-stage). In an embodiment, $d_{binaural}$ is maximized in each frequency band, whereby a resulting binaural speech intelligibility predictor can be provided, e.g. as a single scalar value. In general, no closed-form solution exists for the optimal time-shift/amplitude adjustment, but the optimal parameter pairs may at least be found by a brute-force search across a suitable range of parameter values (see [13] for details of such exhaustive search approach).

Monaural and Binaural Intelligibility Enhancement Using Intelligibility Predictors The methods proposed in the previous sections for non-intrusive monaural and binaural speech intelligibility prediction can be used for online adaptation of the signal processing taking place in a hearing aid system (or another communication device), in order to maximize the speech intelligibility of its output. This general idea is depicted in FIG. 7 for a binaural setting: noisy/reverberant signals $y_1(n), \ldots, y_L(n)$ are picked up by a total of L microphones.

Figure 7:
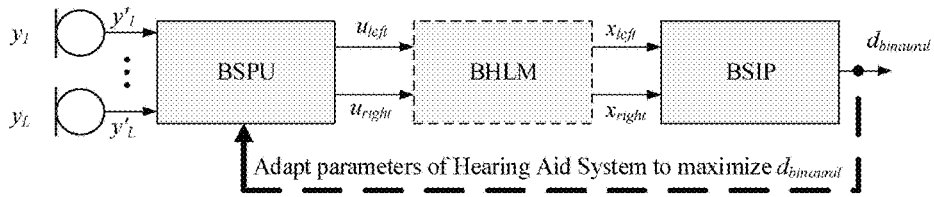

FIG. 7 shows a method of providing an intrusive binaural speech intelligibility predictor $d_{binaural}$ for adapting the processing of a binaural hearing aid systems to maximize the intelligibility of output speech signal(s).

In the binaural setting, the L microphone signals $y'_1, y'_2, \ldots, y'_L$ are processed in binaural signal processor (BSPU) to produce a left- and a right-ear signal, $u_{left}$ and $u_{right}$, e.g. to be presented for a user. In FIG. 7, all L microphones of the hearing aid system together; one or more microphones are generally available from the left- and right-ear hearing aids, respectively, but microphone signals could also be available from external devices, e.g., table microphones, microphones positioned at a target talker, etc. The microphone signals from spatially separated locations are assumed to be transmitted wirelessly (or wired) for processing in the hearing aid system. To estimate the intelligibility experienced by the user when listening binaurally to the left- and right-ear signals, $u_{left}$ and $u_{right}$, the signals are passed through the binaural intelligibility model (BSIP) proposed above, where the binaural hearing loss model (BHLM, see above for some details) is optional. The resulting estimated intelligibility index $d_{binaural}$ is returned to the processing unit (BSPU) of the hearing aid system, which adapts the parameters of relevant signal processing algorithms to maximize $d_{binaural}$.

The adaptation of processing could take place as follows. Let us assume that, the hearing aid system has at its disposal a number of processing schemes, which could be relevant for a particular acoustic situation. For example, in a speech-in-noise situation, the hearing aid system may be equipped with three different noise reduction schemes: mild, medium, and aggressive. In this situation, the hearing aid system applies (e.g. successively) each of the noise reduction schemes to the input signal and chooses the one that leads to maximum (estimated) intelligibility. The hearing aid user need not suffer the perceptual annoyance of the hearing aid system "trying-out" processing schemes. Specifically, the hearing aid system could try out the processing schemes "internally", i.e., without presenting the result of each of the tried-out processing schemes through the loudspeakers—only the output signal which has largest (estimated) intelligibility needs to be presented to the user.

It should be obvious, that this procedure can be applied on a more detailed level as well. In particular, even a value of a single parameter in the hearing aid system, e.g., the maximum attenuation of a noise reduction system in a particular frequency band, may be optimized with respect to intelligibility by trying out a range of candidate values and choosing the one leading to maximum (estimated) intelligibility.

The idea of using non-intrusive speech intelligibility predictors for speech intelligibility enhancement has been described in a general binaural model context. It should be obvious that exactly the same idea could be executed for the better-ear non-intrusive intelligibility model described above, or for a monaural listening situation, using the monaural non-intrusive intelligibility model. These aspects are further described in the following in connection with FIGS. 8A, 8B, and 8C.

Figure 8A:
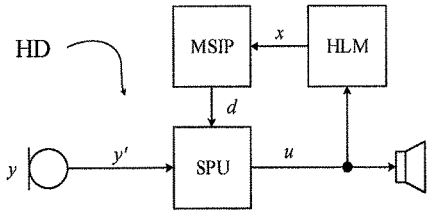
FIG. 8A shows an embodiment of a hearing aid according to the present disclosure comprising a monaural speech intelligibility predictor for estimating intelligibility of an output signal and using the predictor to adapt the signal processing of an input speech signal to maximize the monaural speech intelligibility predictor.

FIG. 8A shows an embodiment of a hearing aid (HD) according to the present disclosure comprising a monaural speech intelligibility predictor unit (MSIP) for estimating intelligibility of an output signal u and using the predictor to adapt the signal processing of an input speech signal y' to maximize the monaural speech intelligibility predictor d. The hearing aid HD comprises at least one input unit (here a microphone, e.g. two or more). The microphone provides a time-variant electric input signal y' representing a sound input y received at the microphone. The electric input signal y' is assumed to comprise a target signal component and a noise signal component (at least in some time segments). The target signal component originates from a target signal source, e.g. a person speaking. The hearing aid further comprises a configurable signal processor (SPU) for processing the electric input signal y' and providing a processed signal u. The hearing aid further comprises an output unit for creating output stimuli configured to be perceivable by the user as sound based on an electric output either in the form of the processed signal u from the signal processor or a signal derived therefrom. In the embodiment of FIG. 8A a loudspeaker is directly connected to the output of the signal processor. (SPU), thus receiving output signal u. The hearing aid further comprises a hearing loss model unit (HLM)

connected to the monaural speech intelligibility predictor unit (MSIP) and the output of the signal processor, and configured to modify the electric output signal u reflecting a hearing impairment of the relevant ear of the user to provide information signal x to the monaural speech intelligibility predictor unit (MSIP). The monaural speech intelligibility predictor unit (MSIP) provides an estimate of the intelligibility of the output signal by the user in the form of the (final) speech intelligibility predictor d, which is fed to a control unit of the configurable signal processor to modify signal processing to optimize d.

Figure 8B:
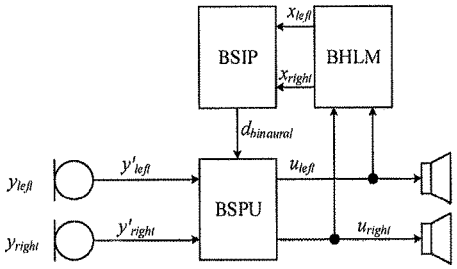
FIG. 8B shows a first embodiment of a binaural hearing aid system according to the present disclosure comprising a binaural speech intelligibility predictor for estimating intelligibility of respective left and right output signals of the binaural hearing aid system and using the predictor to adapt the binaural signal processing of a number of input signals comprising speech to maximize the binaural speech intelligibility predictor, and FIG. 8C a second embodiment of a binaural hearing aid system according to the present disclosure comprising left and right hearing aids and a binaural speech intelligibility predictor for estimating intelligibility of output signals of the respective left and right hearing aids and using the predictor to adapt the signal processing of a number of input signals comprising speech of each of the left and right hearing aids to maximize the binaural speech intelligibility predictor.

FIG. 8B shows a first embodiment of a binaural hearing aid system according to the present disclosure comprising a binaural speech intelligibility predictor unit (BSIP) for estimating the perceived intelligibility of the user when presented with the respective left and right output signals $u_{left}$ and $u_{right}$ of the binaural hearing aid system and using the predictor $d_{binaural}$ adapt the binaural signal processor (BSPU) of input signals $y'_{left}$ and $y'_{right}$ comprising speech to maximize the binaural speech intelligibility predictor $d_{binaural}$. This is done by feeding the output signals $u_{left}$ and $u_{right}$ presented to the user via output respective units (here loudspeakers)

To a binaural hearing loss model that models the (impaired) auditory system of the user and presents resulting left and right signals $x_{left}$ and $x_{right}$ to the binaural speech intelligibility predictor unit (BSIP). The configurable binaural signal processor (BSIP) is adapted to control the processing of the respective electric input signals $y'_{left}$ and $y'_{right}$ based on the final binaural speech intelligibility measure $d_{binaural}$ to optimize said measure thereby maximizing the users' intelligibility of the input sound signals $y_{left}$ and $y_{right}$.

Figure 8C:
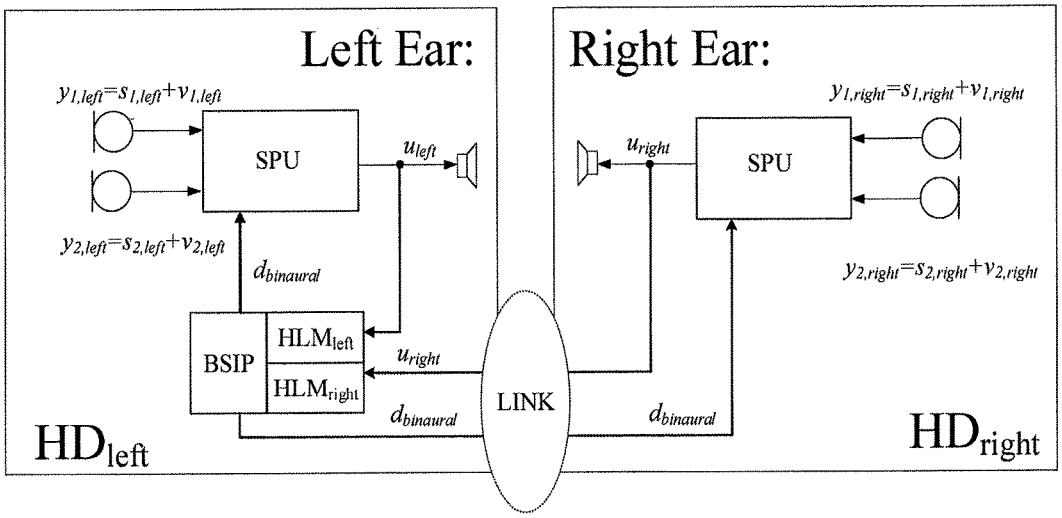

A more detailed embodiment of binaural hearing aid system of FIG. 8B is shown in FIG. 8C. FIG. 8C shows an embodiment of a binaural hearing system comprising left and right hearing aids ($HD_{left}$, $HD_{right}$) according to the present disclosure. The left and right hearing aids ($HD_{left}$, $HD_{right}$) are adapted to be located at or in left and right ears (Left Ear, Right Ear in FIG. 8C) of a user. The signal processing of each of the left and right hearing aids is guided by an estimate of the speech intelligibility experienced by the hearing aid user, the binaural speech intelligibility predictor $d_{binaural}$ (cf. control signal $d_{binaural}$ from the binaural speech intelligibility predictor (BSIP) to the respective signal processors (SPU) of the left and right hearing aids). The binaural speech intelligibility predictor unit (BSIP) is configured to take as inputs the output signals $u_{left}$, $u_{right}$ of left and hearing aids as modified by a hearing loss model ($HLM_{left}$, $HLM_{right}$, respectively, in FIG. 8C) for the respective left and right ears of the user, respectively (to model imperfections of an impaired auditory system of the user). In this example, the speech intelligibility estimation/prediction takes place in the left-ear hearing aid (Left Ear: $HD_{left}$). The output signal $u_{right}$ of the right-ear hearing aid (Right Ear: $HD_{right}$) is transmitted to the left-ear hearing aid (Left Ear: $HD_{left}$) via communication link LINK. The communication link (LINK) may be based on a wired or wireless connection. The hearing aids are preferably wirelessly connected.

Each of the hearing aids ($HD_{left}$, $HD_{right}$) comprise two microphones, a signal processing block (SPU), and a loudspeaker. Additionally, one or both of the hearing aids comprise a binaural speech intelligibility unit (BSIP). The two microphones of each of the left and right hearing aids ($HD_{left}$, $HD_{right}$) each pick up a—potentially noisy (time varying) signal y(t) (cf. $y_{1,left}$, $y_{2,left}$ and $y_{1,right}$, $y_{2,right}$ in FIG. 8C)—and which generally consists of a target signal component s(t) (cf. $s_{1,left}$, $s_{2,left}$ and $s_{1,right}$, $s_{2,right}$ in FIG. 8C) and an undesired signal component v(t) (cf. $v_{1,left}$, $v_{2,left}$ and $v_{1,right}$, $v_{2,right}$ in FIG. 8C). In FIG. 8C, the subscripts 1, 2 indicate a first and second (e.g. front and rear) microphone, respectively, while the subscripts left, right indicate whether it is the left or right ear hearing aid ($HD_{left}$, $HD_{right}$, respectively).

Based on binaural speech intelligibility predictor $d_{binaural}$, the signal processors (SPU) of each hearing aid may be (individually) adapted (cf. control signal $d_{binaural}$). Since the binaural speech intelligibility predictor is determined in the left-ear hearing aid ($HD_{left}$), adaptation of the processing in the right-ear hearing aid ($HD_{right}$) requires control signal $d_{binaural}$ to be transmitted from left to right-ear hearing aid via communication link (LINK).

In FIG. 8C, each of the left and right hearing aids comprise two microphones. In other embodiments, each (or one) of the hearing aids may comprises three or more microphones. Likewise, in FIG. 8C, the binaural speech intelligibility predictor (BSIP) is located in the left hearing aid ($HD_{left}$). Alternatively, the binaural speech intelligibility predictor (BSIP) may be located in the right hearing aid ($HD_{right}$), or alternatively in both, preferably performing the same function in each hearing aid. The latter embodiment consumes more power and requires a two-way exchange of output audio signals ($u_{left}$, $u_{right}$), whereas the exchange of processing control signals ($d_{binaural}$ in FIG. 8C) can be omitted. In still another embodiment, the binaural speech intelligibility predictor unit (BSIP) is located in a separate auxiliary device, e.g. a remote control (e.g. embodied in a SmartPhone), requiring that an audio link can be established between the hearing aids and the auxiliary device for receiving output signals ($u_{left}$, $u_{right}$) from, and transmitting processing control signals ($d_{binaural}$) to, the respective hearing aids ($HD_{left}$, $HD_{right}$).

The processing performed in the signal processors (SPU) and controlled or influenced by the control signals ($d_{binaural}$) of the respective left and right hearing aids ($HD_{left}$, $HD_{right}$) from the binaural speech intelligibility predictor (BSIP) may in principle include any processing algorithm influencing speech intelligibility, e.g. spatial filtering (beamforming) and noise reduction, compression, feedback cancellation, etc. The adaptation of the signal processing of a hearing aid based on the estimated binaural speech intelligibility predictor includes (but are not limited to):

1. Adapting the aggressiveness of beamformers of the hearing system. Specifically, for binaural beamformers, it is well-known that the beamformer configuration involves a trade-off between noise reduction and spatial correctness of the noise cues. In one extreme setting, the noise is maximally reduced, but all noise signals sound as if originating from the direction of the target signal source. The trade-off that leads to maximum SI is generally time-varying and generally unknown. With the proposed approach, however, it is possible to adapt the beamformer stage of a given hearing aid to produce maximum SI at all times.
2. Adapting the aggressiveness of a (single-channel (SC)) noise reduction system. Often a beamformer stage is followed by an SC noise reduction stage (cf. e.g. FIG. 6). The aggressiveness of the SC noise reduction filter is adaptable (e.g. by changing the maximum attenuation allowed by the SC noise reduction filter). The proposed approach allows to choose the SI optimal tradeoff, i.e., a system that suppresses an appropriate amount of noise without introducing SI-disturbing artefacts in the target speech signal.

3. For systems with adaptable analysis/synthesis filterbanks, the analysis/synthesis filter bank leading to maximum SI may be chosen. This implies to change the time-frequency tiling, i.e., the bandwidths and/or sampling rate used in individual subbands to deliver maximum SI in accordance with the target signal and acoustic situation (e.g., noise type, level, spatial distribution, etc.).
4. If the binaural speech intelligibility predictor unit estimates the maximum SI of the binaural hearing system to be so low that it is of no use for the user, then an indication may be given to the user (e.g. via a sound signal), that the HA system is unable to operate in the given acoustical conditions. It may then adapt its processing, e.g. to at least not introduce sound quality degradations, or to go to a "power-saving" mode, where the signal processing is limited to save power.

Figure 9:
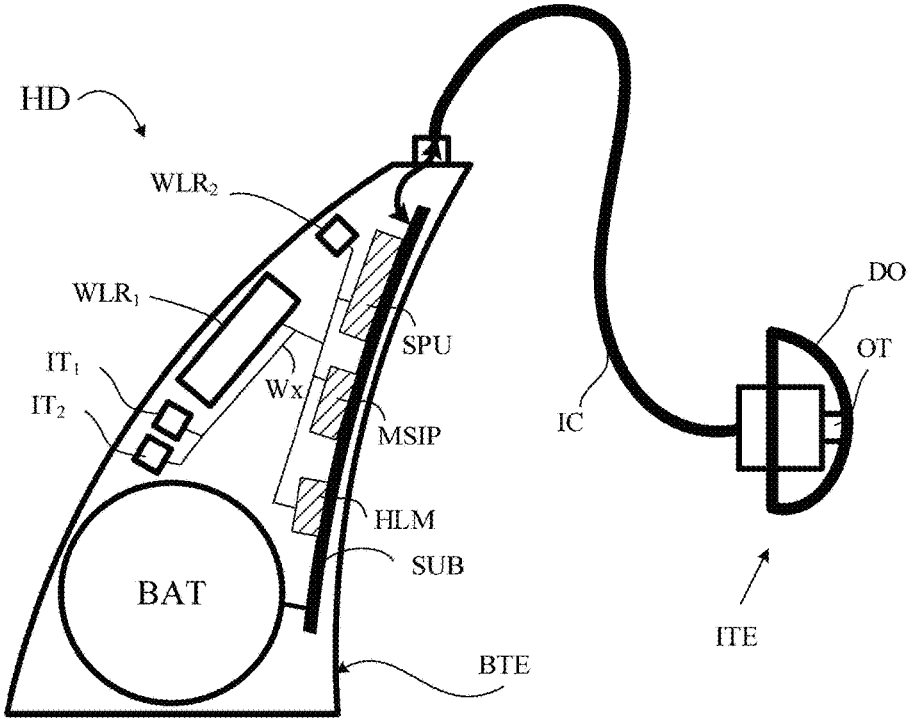
FIG. 9 illustrates an exemplary hearing aid formed as a receiver in the ear (RITE) type of hearing aid comprising a part adapted for being located behind pinna and a part comprising an output transducer (e.g. a loudspeaker/receiver) adapted for being located in an ear canal of the user.

FIG. 9 illustrates an exemplary hearing aid (HD) formed as a receiver in the ear (RITE) type of hearing aid comprising a part (BTE) adapted for being located behind pinna and a part (ITE) comprising an output transducer (OT, e.g. a loudspeaker/receiver) adapted for being located in an ear canal of the user. The BTE-part and the ITE-part are connected (e.g. electrically connected) by a connecting element (IC). In the embodiment of a hearing aid of FIG. 9, the BTE part comprises an input unit comprising two (individually selectable) input transducers (e.g. microphones) ($MIC_1$, $MIC_2$) each for providing an electric input audio signal representative of an input sound signal. The input unit further comprises two (individually selectable) wireless receivers ($WLR_1$, $WLR_2$) for providing respective directly received auxiliary audio and/or information signals. The hearing aid (HA) further comprises a substrate SUB whereon a number of electronic components are mounted, including a configurable signal processor (SPU), a monaural speech intelligibility predictor unit (MSIP), and a hearing loss model unit (coupled to each other and input and output units via electrical conductors Wx), as e.g. described above in connection with 8A. The configurable signal processor (SPU) provides an enhanced audio signal (cf. e.g. signal u in FIG. 8A), which is intended to be presented to a user. In the embodiment of a hearing aid device in FIG. 9, the ITE part comprises an output unit in the form of a loudspeaker (receiver) (OT) for converting an electric signal (e.g. u in FIG. 8A) to an acoustic signal. The ITE-part further comprises a guiding element, e.g. a dome, (DO) for guiding and positioning the ITE-part in the ear canal of the user.

The hearing aid (HD) exemplified in FIG. 9 is a portable device and further comprises a battery (BAT) for energizing electronic components of the BTE- and ITE-parts.

The hearing aid device comprises an input unit for providing an electric input signal representing sound. The input unit comprises one or more input transducers (e.g. microphones) ($MIC_1$, $MIC_2$) for converting an input sound to an electric input signal. The input unit comprises one or more wireless receivers ($WLR_1$, $WLR_2$) for receiving (and possibly transmitting) a wireless signal comprising sound and for providing corresponding directly received auxiliary audio input signals. In an embodiment, the hearing aid device comprises a directional microphone system (beamformer) adapted to enhance a target acoustic source among a multitude of acoustic sources in the local environment of the user wearing the hearing aid device. In an embodiment, the directional system is adapted to detect (such as adaptively detect) from which direction a particular part of the microphone signal originates.

The hearing aid of FIG. 9 may form part of a hearing aid and/or a binaural hearing aid system according to the present disclosure.

Figure 10A:
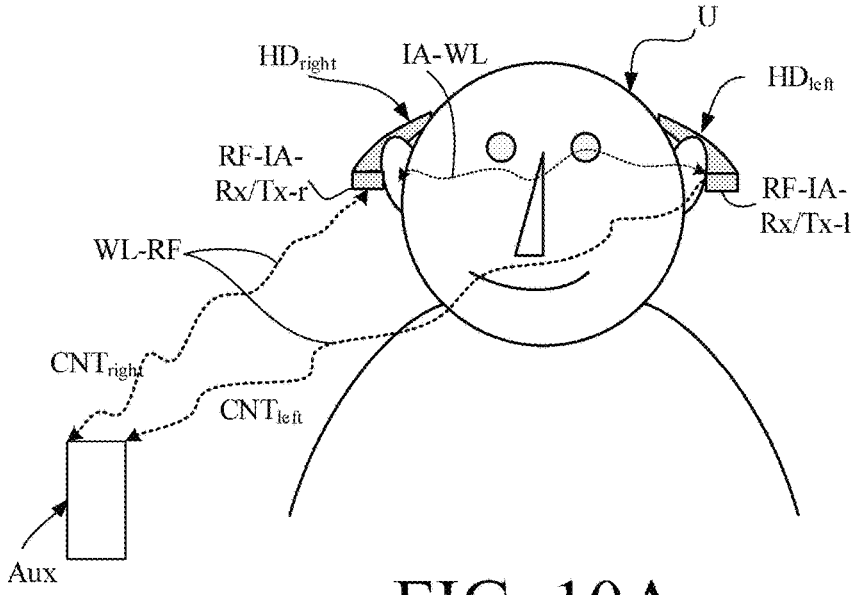
FIG. 10A shows a binaural hearing aid system according to the present disclosure comprising first and second hearing aids and an auxiliary device.
Figure 10B:
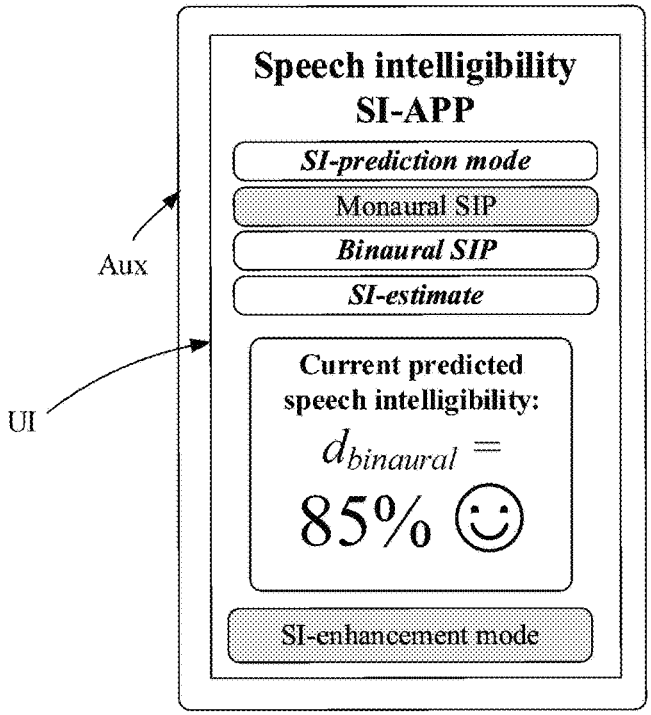
FIG. 10B shows the auxiliary device comprising a user interface in the form of an APP for controlling and displaying data related to the speech intelligibility predictors.

FIG. 10A shows an embodiment of a binaural hearing system comprising left and right hearing aids ($HD_{left}$, $HD_{right}$) in communication with a portable (handheld) auxiliary device (AD) functioning as a user interface (UI) for the binaural hearing aid system (cf. FIG. 10B). In an embodiment, the binaural hearing system comprises the auxiliary device (Aux, and the user interface UI). In the embodiment of FIG. 10A, wireless links denoted IA-WL (e.g. an inductive link between the left and right hearing aids) and WL-RF (e.g. RF-links (e.g. Bluetooth) between the auxiliary device Aux and the left $HD_{left}$, and between the auxiliary device Aux and the right $HD_{right}$, hearing aid, respectively) are indicated (implemented in the devices by corresponding antenna and transceiver circuitry, indicated in FIG. 10A in the left and right hearing aids as RF-IA-Rx/Tx-l and RF-IA-Rx/Tx-r, respectively).

FIG. 10B shows the auxiliary device (Aux) comprising a user interface (UI) in the form of an APP for controlling and displaying data related to the speech intelligibility predictors. The user interface (UI) comprises a display (e.g. a touch sensitive display) displaying a screen of a Speech intelligibility SI-APP for controlling the hearing aid system and a number of predefined actions regarding functionality of the binaural (or monaural) hearing system. In the exemplified (part of the) APP, a user (U) has the option of influencing a mode of operation via the selection of a SI-prediction mode to be a Monaural SIP or Binaural SIP mode. In the screen shown in FIG. 10B. the un-shaded buttons are selected, i.e. Binaural SIP. Further, a show SI-estimate has been activated resulting in a current predicted value of the binaural speech intelligibility predictor $d_{binaural}$=85% is displayed. The grey shaded button Monaural SIP may be selected instead of Binaural SIP. Further, the SI-enhancement mode may be selected to activate processing of the input signal that an optimizes the (monaural or binaural) speech intelligibility predictor.

It is intended that the structural features of the devices described above, either in the detailed description and/or in the claims, may be combined with steps of the method, when appropriately substituted by a corresponding process.

As used, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element but an intervening elements may also be present, unless expressly stated otherwise. Furthermore, "connected" or "coupled" as used herein may include wirelessly connected or coupled. As used herein, the term "and/or" includes any and all combinations of one or more of the associated listed items. The steps of any disclosed method is not limited to the exact order stated herein, unless expressly stated otherwise.

It should be appreciated that reference throughout this specification to "one embodiment" or "an embodiment" or "an aspect" or features included as "may" means that a particular feature, structure or characteristic described in connection with the embodiment is included in at least one embodiment of the disclosure. Furthermore, the particular features, structures or characteristics may be combined as suitable in one or more embodiments of the disclosure. The previous description is provided to enable any person skilled in the art to practice the various aspects described herein. Various modifications to these aspects will be readily apparent to those skilled in the art, and the generic principles defined herein may be applied to other aspects.

The claims are not intended to be limited to the aspects shown herein, but is to be accorded the full scope consistent with the language of the claims, wherein reference to an element in the singular is not intended to mean "one and only one" unless specifically so stated, but rather "one or more." Unless specifically stated otherwise, the term "some" refers to one or more.

Accordingly, the scope should be judged in terms of the claims that follow.

REFERENCES

[1] T. H. Falk, V. Parsa, J. F. Santos, K. Arehart, O. Hazrati, R. Huber, J. M. Kates, and S. Scollie, "Objective Quality and Intelligibility Prediction for Users of Assistive Listening Devices," IEEE Signal Processing Magazine, Vol. 32, No. 2, pp. 114-124, March 2015.

[2] American National Standards Institute, "ANSI S3.5, Methods for the Calculation of the Speech Intelligibility Index," New York 1995.

[3] K. S. Rhebergen and N. J. Versfeld, "A speech intelligibility index based approach to predict the speech reception threshold for sentences in fluctuating noise for normal-hearing listeners," *J. Acoust. Soc. Am.*, vol. 117, no. 4, pp. 2181-2192, 2005.

[4] C. H. Taal, R. C. Hendriks, R. Heusdens, and J. Jensen, "An Algorithm for Intelligibility Prediction of Time-Frequency Weighted Noisy Speech," *IEEE Trans. Audio, Speech, Lang. Process.*, vol. 19, no. 7, pp. 2125-2136, September 2011.

[5] A. W. Bronkhorst, "The cocktail party phenomenon: A review on speech intelligibility in multiple-talker conditions," *Acta Acustica United with Acustica*, vol. 86, no. 1, pp. 117-128, January 2000.

[6] B. C. J. Moore, "Cochlear Hearing Loss, Physiological, Psychological and Technical Issues," Wiley, 2007.

[7] R. Beutelmann and T. Brand, "Prediction of intelligibility in spatial noise and reverberation for normal-hearing and hearing-impaired listeners," *J. Acoust. Soc. Am.*, Vol. 120, no. 1, pp. 331-342, April 2006.

[8] J. R. Deller, J. G. Proakis, and J. H. L. Hansen, "Discrete-Time Processing of Speech Signals," IEEE Press, 2000.

[9] P. C. Loizou, "Speech Enhancement—Theory and Practice," CRC Press, 2007.

[10] T. Dau, D. Püschel, and A. Kohlraush, "A quantitative model of the "effective" signal processing in the auditory system. I. Model structure," *J. Acoust. Soc. Am.,* Vol. 99, no. 6, pp. 3615-3622, 1996.

[11] J. Jensen and Z.-H. Tan, "Minimum Mean-Square Error Estimation of Mel-Frequency Cepstral Features—A Theoretically Consistent Approach," *IEEE Trans. Audio, Speech, Language Process.*, Vol. 23, No. 1, pp. 186-197, 2015.

[12] Y. Ephraim and H. L. Van Trees, "A signal subspace approach for speech enhancement," IEEE Trans. Speech, Audio Proc., vol. 3, no. 4, pp. 251-266, 1995.

[13] A. H. Andersen, J. M. de Haan, Z.-H. Tan, and J. Jensen, "A method for predicting the intelligibility of noisy and non-linearly enhanced binaural speech," Proc. Int. Conf. Acoust., Speech, Signal Processing (ICASSP), pp. 4995-4999, March 2016.

[14] J. Jensen and C. H. Taal, "Speech Intelligibility Prediction based on Mutual Information," IEEE Trans. Audio, Speech, and Language Processing, vol. 22, no. 2, February 2014, pp. 430-440.

The invention claimed is:

1. A monaural speech intelligibility predictor adapted for receiving an information signal x comprising either a clean or noisy and/or processed version of a target speech signal, the speech intelligibility predictor being configured to provide as an output a speech intelligibility predictor value d for the information signal, the speech intelligibility predictor comprising an input that provides a time-frequency representation x(k,m) of said information signal x, k being a frequency bin index, k=1, 2, . . . , K, and m being a time index;

an envelope extractor that provides a time-frequency sub-band representation $x_j(m)$ of the information signal x representing temporal envelopes, or functions thereof, of frequency sub-band signals $x_j(m)$ of said information signal x, j being a frequency sub-band index, j=1, 2, . . . , J, and m being the time index;

a time-frequency segment divider that divides said time-frequency representation $x_j(m)$ of the information signal x into time-frequency segments $X_m$ corresponding to a number N of successive samples of said sub-band signals;

a segment estimator that estimates essentially noise-free time-frequency segments $S_m$ or normalized and/or transformed versions $\tilde{S}_m$ thereof, among said time-frequency segments $X_m$, or normalized and/or transformed versions $\tilde{X}_m$, thereof, respectively;

a normalizer and/or transformer configured to provide at least one normalization and/or transformation operation of rows and at least one normalization and/or transformation operation of columns of said time-frequency segments $S_m$ and $X_m$;

an intermediate speech intelligibility calculator adapted for providing intermediate speech intelligibility coefficients $d_m$ estimating an intelligibility of said time-frequency segment $X_m$, said intermediate speech intelligibility coefficients $d_m$ being based on sample correlation coefficients between row elements or column elements or all elements of said estimated, essentially noise-free time segments $S_m$ or said normalized and/or transformed versions $\tilde{S}_m$ thereof, and said time-frequency segments $X_m$, or said normalized and/or transformed versions $\tilde{X}_m$ thereof, respectively;

a final speech intelligibility calculator that calculates a final speech intelligibility predictor d estimating an intelligibility of said information signal x by combining said intermediate speech intelligibility coefficients $d_m$, or a transformed version thereof, over time.

2. A monaural speech intelligibility predictor according to claim 1 wherein said normalization and/or transformation of rows comprises at least one of the following operations R1) mean normalization of rows, R2) unit-norm normalization of rows, R3) Fourier transform of rows, R4) providing a Fourier magnitude spectrum of rows, and R5) providing the identity operation, and wherein said normalization and/or transformation of columns comprises at least one of the following operations C1) mean normalization of columns, and C2) unit-norm normalization of columns.

3. A monaural speech intelligibility predictor according to claim 2 wherein the normalizer and/or transformer is configured to apply one or more of the following algorithms to the time-frequency segments $X_m$:

R1) Normalization of rows to zero mean:

$$g_1(X)=X=\mu_x^r\underline{1}^T,$$

where $\mu_x^r$ is a J×1 vector whose j'th entry is the mean of the j'th row of X (hence the superscript r in $\mu_x^r$), where $\underline{1}$ denotes an N×1 vector of ones, and where superscript T denotes matrix transposition;

R2) Normalization of rows to unit-norm:

$$g_2(X)=D^r(X)X,$$

where $D^r(X)=\mathrm{diag}(\lfloor 1/\sqrt{X(1,:)X(1,:)^H} \ldots 1/\sqrt{X(J,:)X(J,:)^H}\rfloor)$, and where X(j,:) denotes the j'th row of X, such that $D^r(X)$ is a J×J diagonal matrix with the inverse norm of each row on the main diagonal, and zeros elsewhere (the superscript H denotes Hermitian transposition), pre-multiplication with $D^r(X)$ normalizes the rows of the resulting matrix to unit-norm;

R3) Fourier transformation applied to each row $$g_3(X)=XF,$$

where F is an N×N Fourier matrix;

R4) Fourier transformation applied to each row followed by computing the magnitude of the resulting complex-valued elements $$g_4(X)=|XF|$$

where |•| computes the element-wise magnitudes;

R5) The identity operator $$g_5(X)=X$$

C1) Normalization of columns to zero mean:

$$h_1(X)=X-\underline{1}\mu_x^{c^T},$$

where $\mu_x^c$ is a N×1 vector whose $i^{th}$ entry is the mean of the $i^{th}$ row of X, and where $\underline{1}$ denotes an J×1 vector of ones;

C2) Normalization of columns to unit-norm:

$$h_2(X)=XD^c(X),$$

where $D^c(X)=\mathrm{diag}(\lfloor 1/\sqrt{X(:,1)^H X(:,1)} \ldots 1/\sqrt{X(:,N)^H X(:,N)}\rfloor)$, where X(:,n) denotes the n'th row of X, such that $D^c(X)$ is a diagonal N×N matrix with the inverse norm of each column on the main diagonal, and zeros elsewhere, post-multiplication with $D^c(X)$ normalizes the rows of the resulting matrix to unit-norm.

4. A monaural speech intelligibility predictor according to claim 1 adapted to extract said temporal envelope signals as $$x_j(m) = f\left(\sqrt{\sum_{k=k1(j)}^{k2(j)} |x(k,m)|^2}\right),$$

where j=1, . . . , J and m=1, . . . , M, k1(j) and k2(j) denote DFT bin indices corresponding to lower and higher cut-off frequencies of the $j^{th}$ sub-band, J is the number of sub-bands, and M is the number of signal frames in the signal in question, and f(•) is a function.

5. A monaural speech intelligibility predictor according to claim 4 wherein the function f(•)=f(w), where w represents $$\left(\sqrt{\sum_{k=k1(j)}^{k2(j)} |x(k,m)|^2}\right),$$

is selected among the following functions f(w)=w representing the identity $f(w)=w^2$ providing power envelopes, $f(w)=2\cdot\log w$ or $f(w)=w^\beta$, $0<\beta<2$, allowing the modelling of the compressive non-linearity of the healthy cochlea, or combinations thereof.

6. A monaural speech intelligibility predictor according to claim 1 wherein the segment estimator is configured to estimate the essentially noise-free time-frequency segments $\tilde{S}_m$ from time-frequency segments $\tilde{X}_m$ representing the information signal based on statistical methods.

7. A monaural speech intelligibility predictor according to claim 1 wherein the segment estimator is configured to estimate said essentially noise-free time-frequency segments $S_m$ or normalized and/or transformed versions $\tilde{S}_m$ thereof based on super-vectors $\tilde{x}_m$ derived from time-frequency segments $X_m$ or from normalized and/or transformed time-frequency segments $\tilde{X}_m$ of the information signal, and an estimator $r(\tilde{x}_m)$ that maps the super vectors $\tilde{x}_m$ of the information signal to estimates $\hat{\tilde{s}}_m$ of super vectors $\tilde{s}_m$ representing the essentially noise-free, optionally normalized and/or transformed time-frequency segments $\tilde{S}_m$.

8. A monaural speech intelligibility predictor according to claim 1 wherein the segment estimator is configured to estimate the essentially noise-free time-frequency segments $\tilde{S}_m$ based on a linear estimator.

9. A monaural speech intelligibility predictor according to claim 8 wherein the segment estimator is configured to estimate the essentially noise-free, optionally normalized and/or transformed, time-frequency segments ($S_m$, $\tilde{S}_m$) based on a pre-estimated J·N×J·N sample correlation matrix $$\hat{R}_{\tilde{z}} = \frac{1}{\tilde{M}}\sum_{m=1}^{\tilde{M}} \tilde{z}_m \tilde{z}_m^H,$$

across a training set of super vectors $\tilde{z}_m$ derived from optionally normalized and/or transformed segments of noise-free speech signals $z_m$, where $\tilde{M}$ is the number of entries in the training set.

10. A monaural speech intelligibility predictor according to claim 1 wherein the final speech intelligibility calculator is adapted to calculate the final speech intelligibility predictor d from the intermediate speech intelligibility coefficients $d_m$, optionally transformed by a function $u(d_m)$, as an average over time of said information signal x:

$$d = \frac{1}{M}\sum_{m=1}^{M} u(d_m)$$

where M represents the duration in time units of the speech active parts of said information signal x.

11. A hearing aid adapted for being located at or in left and right ears of a user, or for being fully or partially implanted in the head of the user, the hearing aid comprising a monaural speech intelligibility predictor according to claim 1.

12. A hearing aid according to claim 11 comprising a number of inputs $IU_i$, i=1, . . . , M, M being larger than or equal to one, each being configured to provide a time-variant electric input signal $y'_i$ representing a sound input received at an $i^{th}$ input, the electric input signal $y'_i$ comprising a target signal component and a noise signal component, the target signal component originating from a target signal source;

a configurable signal processor for processing the electric input signals and providing a processed signal u;

an output for creating output stimuli configured to be perceivable by the user as sound based on an electric output either in the form of the processed signal u from the signal processor or a signal derived therefrom; and a hearing loss model operatively connected to the monaural speech intelligibility predictor and configured to apply a frequency dependent modification of the electric output signal reflecting a hearing impairment of the corresponding left or right ear of the user to provide information signal x to the monaural speech intelligibility predictor.

13. A hearing aid according to claim 12 wherein the configurable signal processor is adapted to control or influence the processing of the respective electric input signals based on said final speech intelligibility predictor d provided by the monaural speech intelligibility predictor.

14. A binaural hearing system comprising left and right hearing aids according to claim 11, wherein each of the left and right hearing aids comprises antenna and transceiver circuitry for allowing a communication link to be established and information to be exchanged between said left and right hearing aids.

15. A binaural hearing system according to claim 14 further comprising a binaural speech intelligibility prediction for providing a final binaural speech intelligibility measure $d_{binaural}$ of the predicted speech intelligibility of the user, when exposed to said sound input, based on the monaural speech intelligibility predictor values $d_{left}$, $d_{right}$ of the respective left and right hearing aids.

16. A binaural hearing system according to claim 15 wherein the final binaural speech intelligibility measure $d_{binaural}$ is determined as the maximum of the speech intelligibility predictor values $d_{left}$, $d_{right}$ of the respective left and right hearing aids: $d_{binaural}=\max(d_{left}, d_{right})$.

17. A method of providing a monaural speech intelligibility predictor for estimating a user's ability to understand an information signal x comprising either a clean or noisy and/or processed version of a target speech signal, the method comprising providing a time-frequency representation x(k,m) of said information signal x, k being a frequency bin index, k=1, 2, . . . , K, and m being a time index;

extracting temporal envelopes of said frequency time-frequency representation x(k,m) providing a time-frequency sub-band representation $x_j(m)$ of the information signal x representing temporal envelopes, or functions thereof, in the form of frequency sub-band signals $x_j(m)$, j being a frequency sub-band index, j=1, 2, . . . , J, and m being the time index;

dividing said time-frequency representation $x_j(m)$ of the information signal x into time-frequency segments $X_m$ corresponding to a number N of successive samples of said sub-band signals;

estimating essentially noise-free time-frequency segments $S_m$ or normalized and/or transformed versions $\tilde{S}_m$, thereof, among said time-frequency segments $X_m$, or normalized and/or transformed versions $\tilde{X}_m$ thereof, respectively;

providing at least one normalization and/or transformation operation of rows and at least one normalization and/or transformation operation of columns of said time-frequency segments $S_m$ and $X_m$;

providing intermediate speech intelligibility coefficients $d_m$ estimating an intelligibility of said time-frequency segment $X_m$, said intermediate speech intelligibility coefficients $d_m$ being based on sample correlation coefficients between row elements or column elements or all elements of said estimated, essentially noise-free time segments $S_m$ or normalized and/or transformed versions $\tilde{S}_m$, thereof, and said time-frequency segments $X_m$, or normalized and/or transformed versions $\tilde{X}_m$ thereof, respectively;

calculating a final speech intelligibility predictor d estimating an intelligibility of said information signal x by combining said intermediate speech intelligibility coefficients $d_m$, or a transformed version thereof, over time, e.g. in a single scalar value.

18. A data processing system comprising:

a processor; and a computer readable medium having stored thereon program code for causing the processor to perform the method according to claim 17.

19. A non-transitory computer readable medium having stored thereon instructions which, when executed by a computer, cause the computer to carry out the method according to claim 17.

20. A monaural speech intelligibility predictor according to claim 1, wherein said intermediate speech intelligibility coefficients $d_m$ are defined as'

1) the average sample correlation coefficient of the columns in $\hat{\tilde{S}}_m$ and $\acute{X}_m$, i.e., $$d_m = \frac{1}{N}\sum_{n=1}^{N} d\left(\hat{\tilde{S}}_m(:,n), \tilde{X}_m(:,n)\right), \text{ or as}$$

2) the average sample correlation coefficient of the rows in $\hat{\tilde{S}}_m$ and $\acute{X}_m$, i.e., $$d_m = \frac{1}{j}\sum_{j=1}^{J} d\left(\hat{\tilde{S}}_m(j,:)^T, \tilde{X}_m(j,:)^T\right), \text{ or as}$$

3) the sample correlation coefficient of all elements in $\hat{\tilde{S}}_m$ and $\tilde{X}_m$, i.e., $$d_m = d\left(\hat{\tilde{S}}_m, \tilde{X}_m\right).$$

21. A monaural speech intelligibility predictor according to claim 1, wherein said combining of said intermediate speech intelligibility coefficients $d_m$, or a transformed version thereof, over time includes averaging or applying a MIN or MAX-function.

* * * * *